US010139187B2

(12) United States Patent
Houle

(10) Patent No.: US 10,139,187 B2
(45) **Date of Patent: *Nov. 27, 2018**

(54) CROSSBOW WITH ATTACHMENT FOR PROTECTING BROADHEAD OF ARROW

(71) Applicant: PLACEMENTS GASTON HOULE INC., Wickham (CA)

(72) Inventor: Gaston Houle, Wickham (CA)

(73) Assignee: PLACEMENTS GASTON HOULE INC., Wickham (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/534,608

(22) Filed: Nov. 6, 2014

(65) Prior Publication Data

US 2015/0128923 A1 May 14, 2015

Related U.S. Application Data

(60) Provisional application No. 61/904,052, filed on Nov. 14, 2013.

(51) Int. Cl.
*F41B 5/12* (2006.01)
*F41B 5/14* (2006.01)

(52) U.S. Cl.
CPC ..... *F41B 5/12* (2013.01); *F41B 5/1469* (2013.01)

(58) Field of Classification Search
CPC ..... F41B 5/12; F41B 5/1469
USPC ..... 124/25
See application file for complete search history.

(56) References Cited

U.S. PATENT DOCUMENTS

| | | | | | |
|---|---|---|---|---|---|
| 577,641 | A * | 2/1897 | Bruder | F41B 5/12 | 124/25 |
| 2,814,284 | A * | 11/1957 | Sileo | F41B 5/12 | 124/25 |
| 2,842,114 | A | 7/1958 | Duncan | | |
| 3,515,113 | A * | 6/1970 | Lawrence | F41B 5/12 | 124/25 |
| 4,587,944 | A | 5/1986 | Barnett | | |
| 5,095,883 | A * | 3/1992 | Kurtz | F41B 5/10 | 124/25 |
| 5,437,260 | A | 8/1995 | King | | |

(Continued)

FOREIGN PATENT DOCUMENTS

| | | |
|---|---|---|
| CN | 201413078 | 12/2012 |
| FR | 2765959 | 1/1999 |

(Continued)

OTHER PUBLICATIONS

English Translation of FR2765959A1, Oct. 29, 2016, European Patent Office.*

(Continued)

*Primary Examiner* — Gene Kim
*Assistant Examiner* — Jeffrey Vanderveen
(74) *Attorney, Agent, or Firm* — Mathieu Audet

(57) ABSTRACT

A crossbow with a stirrup disposed on the distal end of the body, the stirrup including an arrow protector disposed along the arrow trajectory, on the first end of the body, to generally circumvent the arrow, when the crossbow is used in conjunction with the arrow. An arrow protector adapted to be retrofitted on a crossbow is encompassed by the present application. An arrow protector improving stability of the crossbow when axially resting on the ground is also presented herein.

17 Claims, 28 Drawing Sheets

(56) References Cited

U.S. PATENT DOCUMENTS

| | | | | |
|---|---|---|---|---|
| 5,522,373 | A | 6/1996 | Barnett | |
| 5,720,268 | A * | 2/1998 | Koltze | F41B 5/0094 124/23.1 |
| 6,868,845 | B1 | 3/2005 | Moore | |
| 8,522,767 | B1 | 9/2013 | Kuhn | |
| 8,689,774 | B1 | 4/2014 | Ritz | |
| 8,978,636 | B2 * | 3/2015 | Bednar | F41B 5/1426 124/25 |
| 2002/0020403 | A1 | 2/2002 | Troubridge | |
| 2005/0076894 | A1 | 4/2005 | Crites, Jr. | |
| 2010/0224176 | A1 | 9/2010 | Kaylan | |
| 2013/0061836 | A1 | 3/2013 | Kempf | |
| 2013/0174825 | A1 | 7/2013 | Bednar | |
| 2013/0213371 | A1 | 8/2013 | Biafore, Jr. | |
| 2013/0213373 | A1 * | 8/2013 | Biafore, Jr. | F41B 5/12 124/25 |
| 2013/0291847 | A1 | 11/2013 | Darlington | |
| 2014/0069401 | A1 * | 3/2014 | McPherson | F41B 5/12 124/25 |
| 2014/0069404 | A1 | 3/2014 | McPherson | |
| 2016/0146564 | A1 * | 5/2016 | McPherson | F41B 5/123 124/25 |

FOREIGN PATENT DOCUMENTS

| | | | |
|---|---|---|---|
| FR | 2765959 A1 * | 1/1999 | F41B 5/12 |
| TW | 200804751 | 1/2008 | |
| WO | WO 2011/070433 | 2/2010 | |

OTHER PUBLICATIONS

Maximus Crossbow's Ergo, in Bowhunting Blog, by James Hendricks, published by Excalibur Crossbow, Kitchener (ON), Canada, Dec. 30, 2013, www.bowhunting.com.

Reconstructing a Historic Crossbow, in Reconstructing a Medieval Crossbow, by James Bayne, published by All things medieval, Dec. 30, 2013, www.medieval.stormthecastle.com.

Webpage of TRUBLO Bow Jack, published by TRUGLO Inc (Richardson, TX, USA). Feb. 17, 2017; http://www.truglo.com/archery-bow-accessories/bow-jack.asp.

Webpage of 1012b Stirrup dampeners for crossbow, published by Bowjax, May 23, 2016. http://www.bowjax.com/p/1012b-stirrup-dampeners-for-crossbows-2-per-pack.

* cited by examiner

CROSSBOW WITH ATTACHMENT FOR PROTECTING BROADHEAD OF ARROW

CROSS-REFERENCES

The present application is a non-provisional application of, and claims priority under 35 U.S.C. 119(e) to, U.S. provisional patent application No. 61/904,052 filed Nov. 14, 2013, entitled STIRRUP FOR CROSSBOW AND METHOD OF MANUFACTURING THEREOF, filed under 35 U.S.C. 111(b), which is incorporated herein by reference in its entirety.

BACKGROUND OF THE INVENTION

1. Field of the Invention

This invention generally relates to crossbow improvements. The present invention more specifically relates to an arrow protector used to protect an arrow used in conjunction with a crossbow. The present invention also more specifically relates to other features adapted to complement the crossbow.

2. Description of the Related Art

Crossbows are known since a long time as, originally, a war tool and, later, an alternative to guns for hunting and recreation shooting. Crossbows are designed to pretense the string thereof and install an arrow in a position ready to shoot. The crossbow configuration locates a stirrup at a longitudinal distal end thereof, where the arrow is propelled by the string. The crossbow is generally heading down resting on its stirrup in contact with the ground to receive a foot therein to firmly maintain the crossbow to the ground in opposition to the tension required to proximally pull, generally by hand power or by a manual mechanism, the string and lock the string in a position adapted to longitudinally propel the arrow when the tension in the string is released.

One understands the location of the stirrup locate a foot of a user of the crossbow in a position that is interfering with the movement of the arrow when the arrow is installed on the crossbow and propelled by releasing the tension in the string when uncocking.

This can happen when removing the tension in the string and forgetting the arrow in position on the crossbow. Forgetting the arrow on the crossbow can easily happen because the usual beginning and ending of a hunting period happens in the dark before sunrise and after sunset and the user might not visually see the arrow.

Should the arrow be propelled with an interfering foot in the stirrup happen, the arrow is likely to hit the foot and plant in the ground and keep the person with the arrow across his/her foot secured to the ground with the crossbow.

The stirrup of the crossbow is sized and designed to accommodate a single foot therein. Using only one foot to stabilize the crossbow is not optimal to maintain the crossbow in a stable position thus raising additional safety issues especially with pulling the sting to apply tension in the string when arming/cocking the crossbow.

The stirrup is narrow and does not provide significant angular support to the crossbow when the stirrup is on the ground to apply tension in the string.

The arrow installed on the crossbow in a position ready to be fired is not protected and the user of the crossbow cannot prevent foreign object to contact the arrow and risk to move the arrow from its optimal operating position. Conversely, debris can get stuck between the arrow and the riser and move the arrow out of place. This can happen when the user of the crossbow evolves in low visibility or in daylight in the bush and especially when the user of the crossbow is wearing the crossbow on its back while circulating in the forest or climbing in a tree stand.

It is therefore desirable to provide an improved crossbow structure over the existing art that prevents an interference between the broadhead of the arrow and the foot of a user.

It is also desirable to provide an improved stirrup structure over the existing art that prevents an interference between the broadhead of the arrow and the foot of a user.

It is desirable to provide a stirrup structure adapted to damp vibrations of the crossbow in order to reduce the operating noise of the crossbow.

It is equally desirable to provide an improved stirrup structure over the existing art that prevents an interference between the broadhead of the arrow and the foot of a user that could be retrofitted on an existing crossbow.

It is desirable to provide an arrow protector configured to protect an arrow installed on the crossbow in an armed position ready to be propelled by the crossbow.

It is also desirable to provide an improved stirrup structure over the existing art that prevents an interference between the broadhead of the arrow and the foot of a user that could reuse the stirrup of the crossbow and be retrofitted on the existing crossbow with an intervening part that relocate the stirrup not located to result in an interference between the arrow's axis and the foot in the stirrup.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention is generally described as a device adapted to safely allow cocking a string of a crossbow and other improvements thereof.

Aspects of our work provide a stirrup configured to locate the foot of a user therein away from a trajectory of an arrow installed on the crossbow when cocking/uncocking the string of the crossbow and when the crossbow is ready to propel the arrow.

Aspects of our work provide a crossbow equipped with a stirrup configured to locate the foot of a user therein away from the trajectory of an arrow installed on the crossbow when cocking/uncocking the string of the crossbow and when the crossbow is ready to propel the arrow.

Aspects of our work provide a stirrup support configured to locate the foot of a user that is located in the stirrup away from the trajectory of an arrow installed on the crossbow when cocking/uncocking the string of the crossbow and when the crossbow is ready to propel the arrow.

Aspects of our work provide a kit comprising a stirrup configured to be installed on a crossbow and adapted to position the foot of a user that is located in the stirrup away from the trajectory of an arrow installed on the crossbow when cocking/uncocking the string of the crossbow and when the crossbow is ready to propel the arrow.

Aspects of our work provide a stirrup for a crossbow, the stirrup comprising a stirrup adapted to be secured to a distal end of a crossbow, the stirrup including a frame and a foot-receiving portion thereof, the frame being located down from a longitudinal axis of the crossbow to locate a foot on the foot-receiving portion away from the longitudinal axis to prevent an interference between the foot and an arrow propelled by the crossbow along the longitudinal axis.

Aspects of our work provide a stirrup adapted to receive therein one foot or two feet therein.

Aspects of our work provide a "T" shaped stirrup.

Aspects of our work provide a stirrup sized and configured to minimize the height of cocking and improves the ergonomics of the position of a user thereof.

Aspects of our work provide a foot stopper configured to limit how deep a foot can go inside the stirrup. The foot stopper can alternatively be connected or build in the stirrup, the stirrup support and the distal portion of the crossbow.

Aspects of our work provide an adjustable stirrup adapted to change a length between the stirrup and the trigger of the crossbow to adjust the crossbow configuration in accordance with users having various heights.

Aspects of our work provide an arrow protector adapted to protect an arrow installed on the crossbow.

Aspects of our work provide an arrow protector adapted to contact the ground and server as a crossbow support when the crossbow is in a cogging position.

Aspects of our work provide a stirrup assembly including a stirrup and an arrow protector collectively providing a triangular ground-contacting support capable of maintaining the crossbow vertically on the ground.

Aspects of our work provide a stirrup adapted to absorb vibrations when the arrow is propelled.

Aspects of our work provide a stirrup including polymer.

Aspects of our work provide a stirrup including vibration absorbing material.

Aspects of our work provide a stirrup including vibration absorbing elements thereon.

Aspects of our work provide a stirrup including viscoelastic damping material.

Aspects of our work provide a stirrup including elastic and viscoelastic damping capable material.

Aspects of our work provide a stirrup providing vibration isolation.

Aspects of our work provide a stirrup including vibration absorbing elements receivers thereon.

Aspects of our work provide a crossbow comprising a body including a longitudinal axis; a pair of limbs affixed on a distal end of the body, the pair of limbs being adapted to move between a distal relaxed position and a proximal tensed position for accumulating energy therein; a string mounted on respective transversal sides of the pair of limbs in a substantially orthogonal direction in respect with the body for tensing the pair of limbs when proximally longitudinally pulled away from the distal end of the body and adapted to block the pair of limbs in the tensed position for longitudinally propelling an arrow along the longitudinal axis in a distal direction when the string is selectively released to bring back the pair of limbs in the distal relaxed position; and an arrow protector disposed along the longitudinal axis, on the first end of the body, to generally circumvent the arrow, when the crossbow is used in conjunction with the arrow.

An arrow protector adapted to be attached proximate to a distal end of a crossbow to protect an arrow when the arrow protector is used in conjunction with the crossbow and the arrow, the arrow protector comprising: a body including a cavity disposed along a trajectory of the arrow, the cavity being sized and designed to receive the arrow therein, the arrow protector longitudinally and distally extending further than the forward end of the arrow when the pair of limbs in the tensed position and the arrow in a position to be propelled.

Aspects of our work provide a crossbow comprising a body including a longitudinal axis; a pair of limbs affixed on a distal end of the body, the pair of limbs being adapted to move between a distal relaxed position and a proximal tensed position for accumulating energy thereof; a string mounted on respective transversal sides of the pair of limbs in a substantially orthogonal direction in respect with the body for tensing the pair of limbs when proximally longitudinally pulled away from the distal end and blocking the pair of limbs in the tensed position for longitudinally propelling an arrow along an arrow trajectory in a longitudinal and distal direction when the string is selectively released to bring back the pair of limbs the distal relaxed position; and a stirrup disposed on the distal end of the body, the stirrup including a foot-receiving portion for securing the distal end of the body to the ground with a foot applying pressure on the stirrup toward the ground when cocking the string of the crossbow, wherein the foot-receiving portion of the stirrup is configured to receive and locate a foot away from the trajectory of the arrow to prevent an interference between the trajectory of the arrow and the foot.

Aspects of our work provide a stirrup adapted to be attached in about a distal end of a crossbow, the stirrup comprising: a foot-receiving portion for maintaining the distal end of the crossbow to the ground with a foot applying pressure on the stirrup toward the ground when cocking the crossbow, wherein the foot-receiving portion of the stirrup is configured to receive and locate a foot away from a trajectory of an arrow used in combination with the crossbow to prevent an interference between the trajectory of the arrow and the foot when the stirrup is used in conjunction with the crossbow.

Each of the embodiments of the present invention has at least one of the above-mentioned objects and/or aspects, but does not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Our work is now described with reference to the figures. In the following description, for purposes of explanations, numerous specific details are set forth in order to provide a thorough understanding of the present invention by way of embodiment(s). It may be evident, however, that the present invention may be practiced without these specific details.

Figure 1:
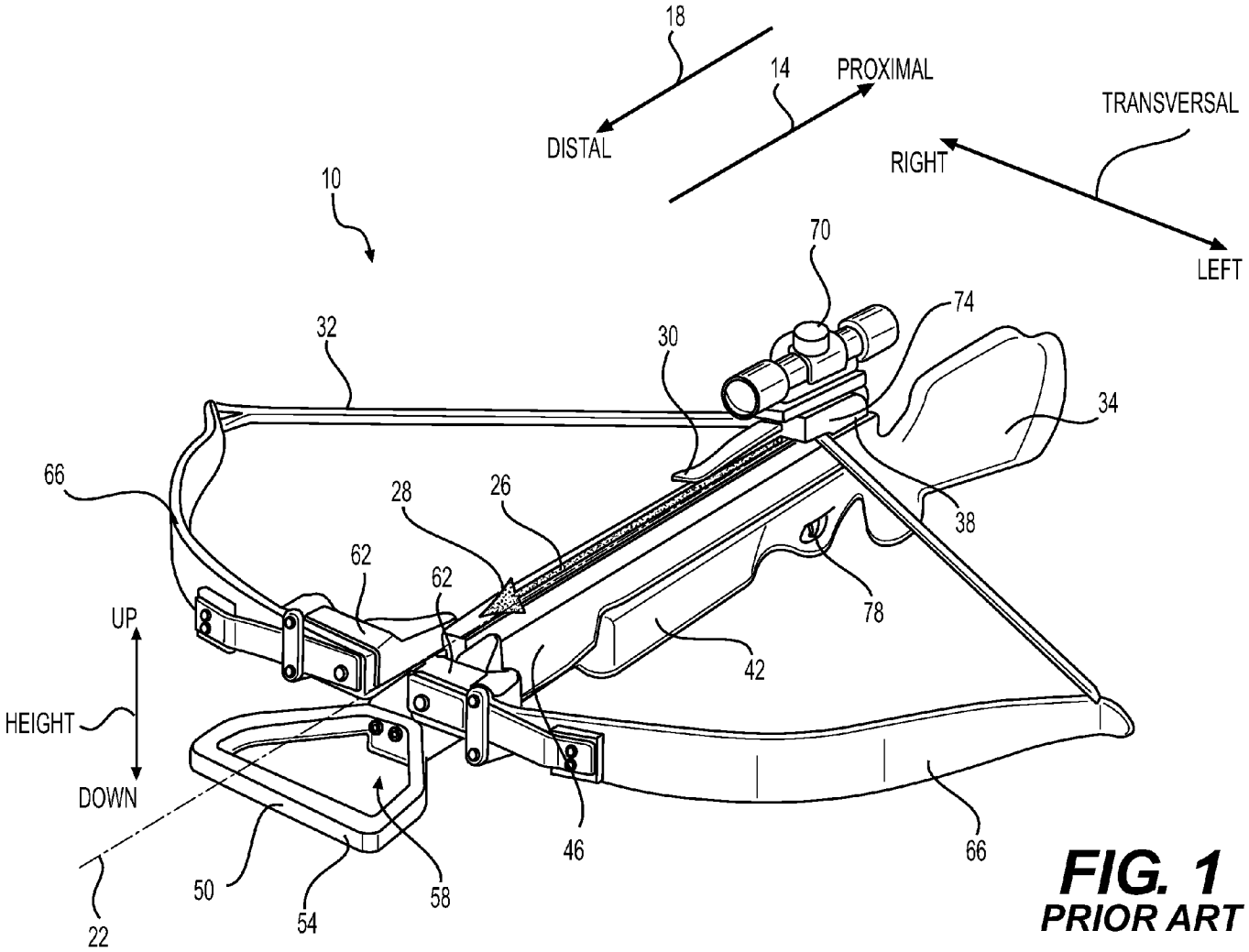
FIG. 1 PRIOR ART
FIG. 1 is an illustration of an exemplary crossbow.

A crossbow 10 is illustrated in FIG. 1, the crossbow 10 includes a side proximal 14 to the user and a side distal 18 to the user 90 when the crossbow 10 is held by a user in a shooting position. The crossbow 10 includes a longitudinal axis 22 along which an arrow 26, when properly installed on the crossbow 10 in its flight groove and optionally held by a arrow retention spring 30, is properly located to be propelled by a string 32. The crossbow 10 further comprises a stock 34, a sight bridge 38, a foregrip 42 and a barrel 46. On its distal 18 end, the crossbow 10 has a stirrup 50 disposed thereon. The stirrup 50 includes a frame 54 and a foot-receiving portion 58 disposed therein. The stirrup 50 is configured to help the user 90 of the crossbow to cock the string 32. Generally, the distal 18 end of the crossbow 10 is put on the ground, the user 90 puts a foot on the stirrup 50 and holds the stirrup 50 on the ground with a foot pressure against the tensing string 32. As illustrated, the stirrup 50 is fastened to the distal end 18 of the barrel 46 next to the riser 62 to which are connected a pair of limbs 66 on respective transversal side thereof. The pair of limbs 66 is adapted to be flexed to accumulate energy that is selectively released to propel the arrow 26. The crossbow 10 is further equipped with an optional sight 70 and a latch 74 holds the tensed string 32 that can be selectively released to release the string 32 and propel the arrow 26 upon actuation of the trigger 78 by the user 90.

Figure 2:
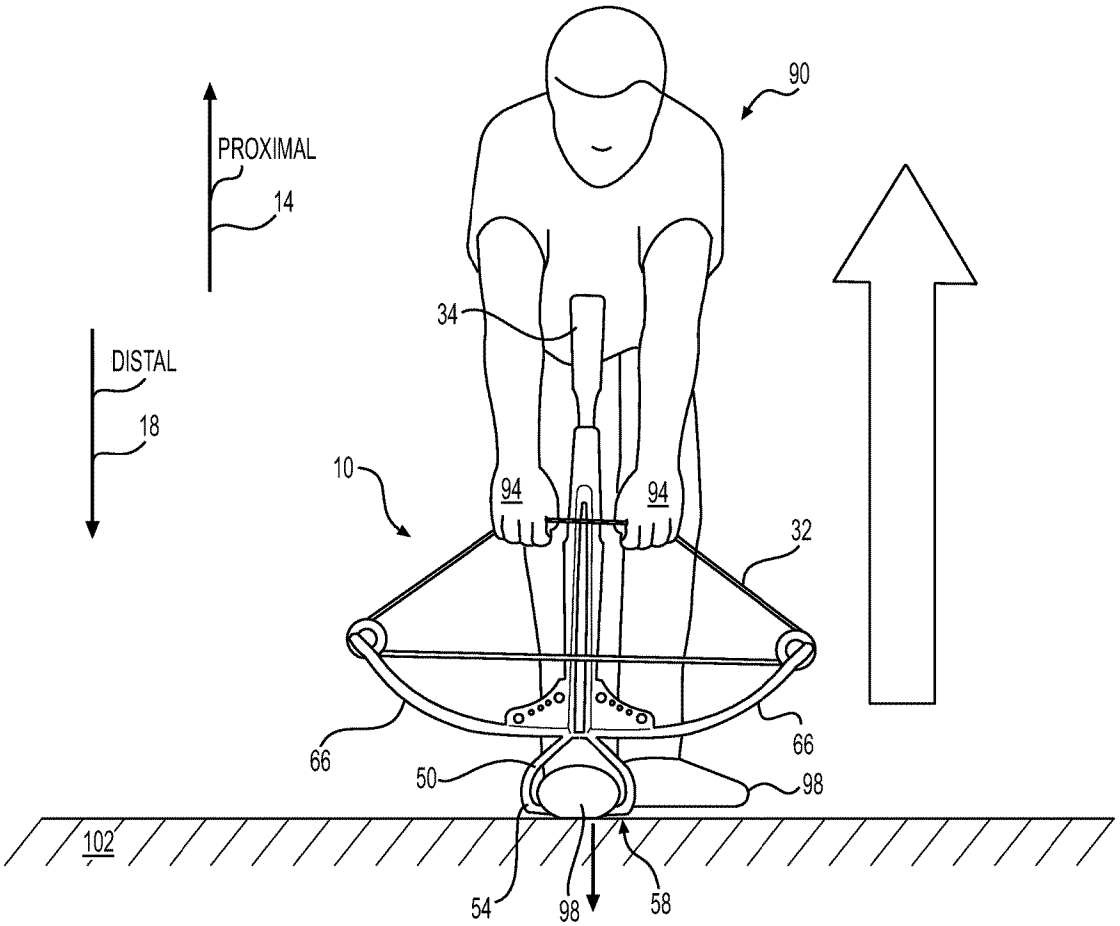
FIG. 2 is a schematic illustration of a person cocking a crossbow.

Turning now to FIG. 2 illustrating a typical cocking by hand of a crossbow 10 by a user 90 using his/her hands 94 to pull the string 32 toward the proximal side 14 of the crossbow 10. Simultaneously, the user 90 is using one foot 98 on the stirrup 50 to apply pressure distally 18 toward the ground 102 to maintain the crossbow 10 on the ground 102 and counterbalance the tension applied proximally 14 to the string 32 to cock the crossbow 10.

Figure 3:
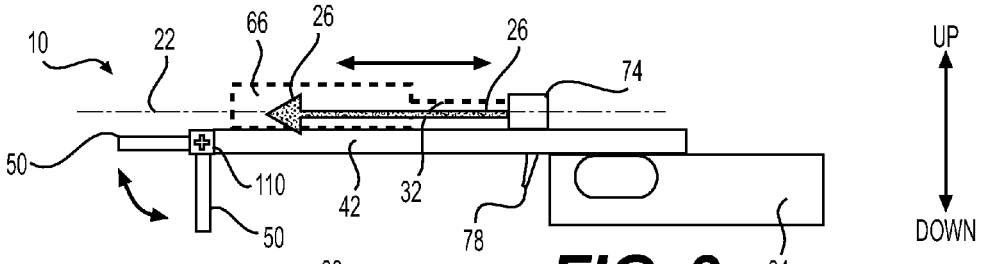
FIG. 3 PRIOR ART
FIG. 3 is a schematic illustration of a left elevational side view of a crossbow.
Figure 4:
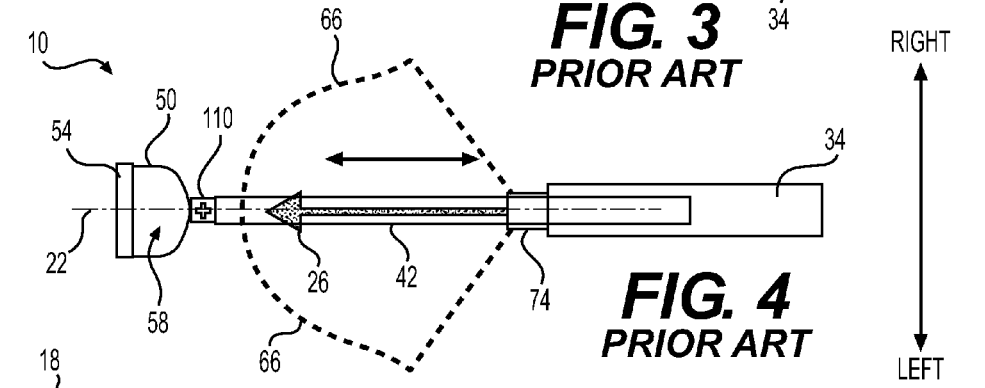
FIG. 4 PRIOR ART
FIG. 4 is a schematic illustration of a top plan view of a crossbow.
Figure 5:
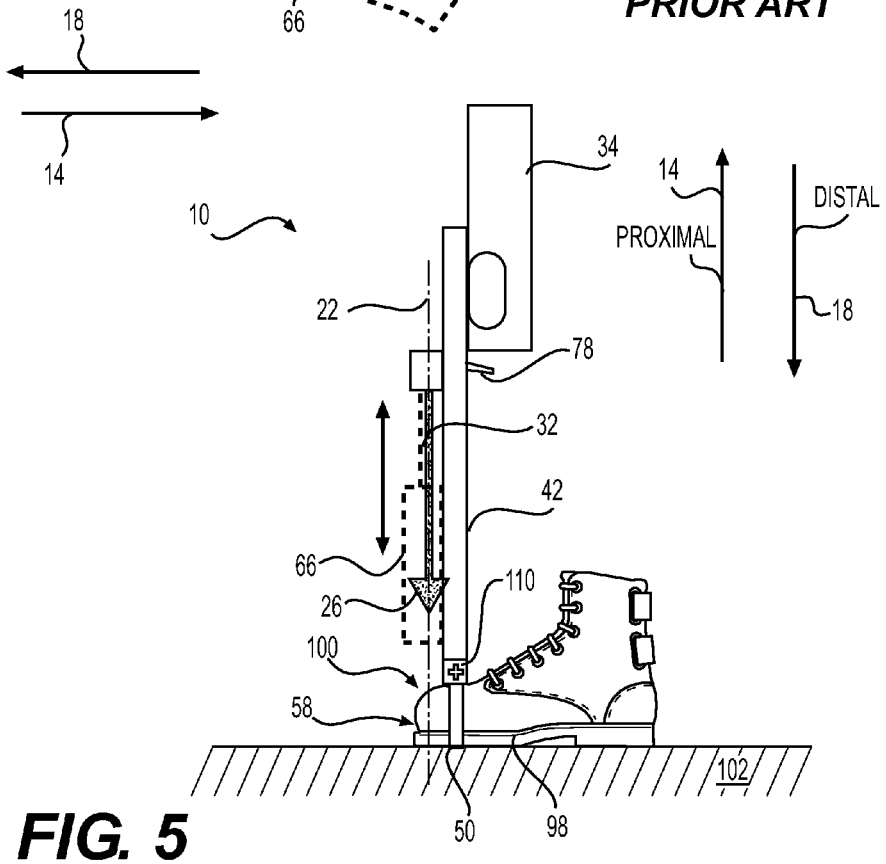
FIG. 5 PRIOR ART
FIG. 5 is a schematic illustration of a crossbow and an interference between a longitudinal axis of the crossbow and a foot of a user cocking the crossbow with a foot in the stirrup.

FIGS. 3-5 illustrate a schematic prior art crossbow 10 from various directions. The stirrup 50 is adapted to be folded on the crossbow 10 of FIG. 3. One can appreciate from FIG. 5 that the arrow axial trajectory 22 interferes 100 with the foot 98 of the crossbow 10 user. The foot 98 of the user 90 is thus dangerously located in the trajectory of the arrow 26 and serious injury can happen should the arrow 26 be propelled accidentally. The arrow 26 could even secure the foot of the user 90 in the ground 102, locking the foot of the user 90 through the stirrup 50 if the arrow 26 is propelled and passes through the foot 98 of the user 90 through the stirrup 50. As one can imagine, this is not a desirable position, especially in the woods late at night.

Figure 6:
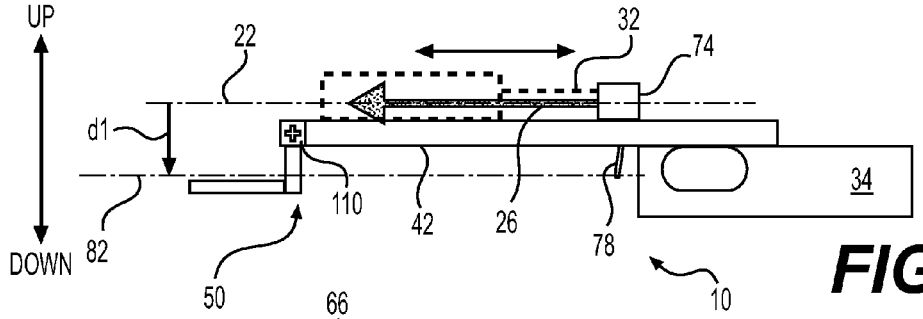
FIG. 6 is a schematic illustration of a left elevational side view of a crossbow in accordance with an embodiment of the present invention.
Figure 7:
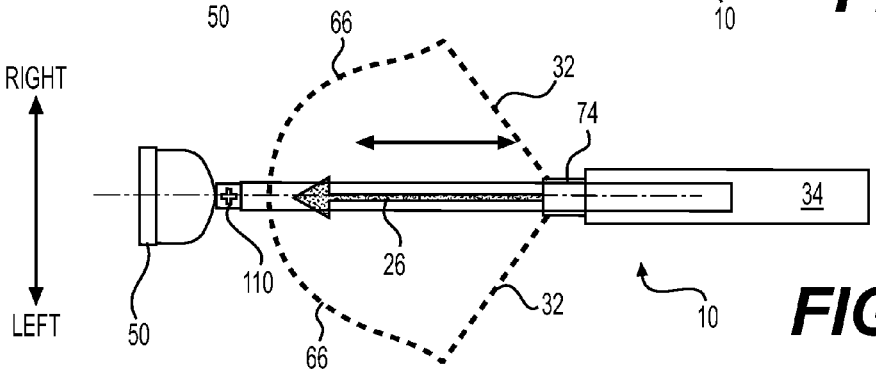
FIG. 7 is a schematic illustration of a top plan view of a crossbow in accordance with an embodiment of the present invention.
Figure 8:
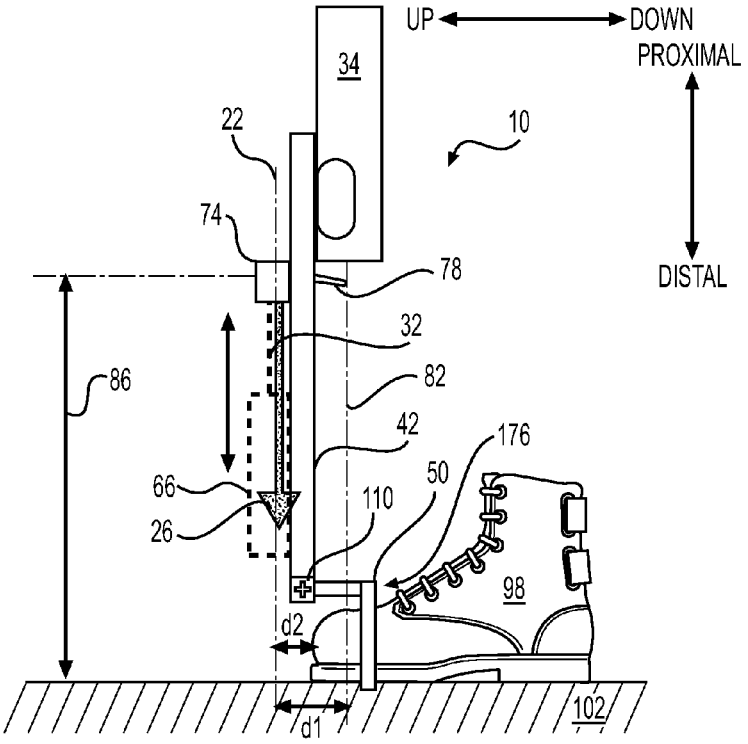
FIG. 8 is a schematic illustration of a crossbow and a non-interference between a longitudinal axis of the crossbow and a foot of a user cocking the crossbow with a foot in the stirrup in accordance with an embodiment of the present invention.

In contrast, FIGS. 6-8 illustrate a crossbow 10 equipped with a stirrup 50 having a configuration preventing an interference between the longitudinal axis 22 of the trajectory of the arrow 26 and the foot 98 of a user 90. In the present situation, the stirrup 50 is located at a greater distance d1 from the longitudinal axis 22, as depicted in FIG. 6, to distance the foot 98 from the longitudinal axis 22 by a distance d2 and thus protects the foot 98 of the user against the arrow 26 trajectory 22. In at least one embodiment, the stirrup 50 is located downward of a trigger longitudinal axis 82 to further locate the foot of a user 90 away from the trajectory of the arrow 26.

Embodiments of the stirrup 50 can be sold with a new crossbow 10 or can be sold separately to retrofit an existing crossbow 10 without departing from the scope of the present invention. The stirrup 50 has, preferably, a securing mechanism that is compatible with common securing mechanisms of existing crossbows 10. Securing the stirrup 50 of embodiments is generally using the existing fastening mechanism of crossbows 10 on the market.

Figure 17:
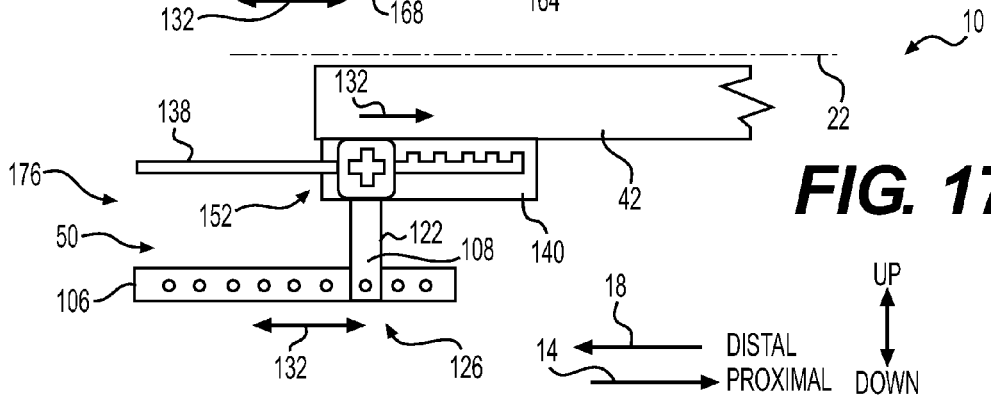
FIG. 17 is a schematic illustration of a stirrup with an adjustable stirrup support and a foot stopper in accordance with an embodiment of the present invention.

The location of the stirrup 50 in embodiments of the present application is offset from the longitudinal axis 22 of the arrow and hence away from the barrel 46 and the limbs 66 as depicted in FIG. 8. The offset location of the stirrup 50 gives more proximal space to the foot 98, or the feet 98, of the user 90. The arrangement of the stirrup 50 with the crossbow 10 can be longitudinally more compact because there is more room to locate the stirrup 50 closer to crossbow 10. The longitudinal length of the stirrup 50 and crossbow 10 assembly can hence be shorter. The shorter crossbow length is advantageous, inter alia, because it is lowering the displacement of the string 32 when cocking the string 32. A lower displacement is more ergonomic, especially for shorter users 90, because the elbows of the user 90 have to raise less high when cocking the string 32 and less strength is required. The position of the stirrup 50 of embodiments can optionally be adjustable and allows setting a desired longitudinal distance 86 between the stirrup 50 and the latch 74 to adapt to users of different sizes and heights. This adjustable stirrup 50 is illustrated in FIG. 10 and FIG. 12 throughout FIG. 17.

Figure 9:
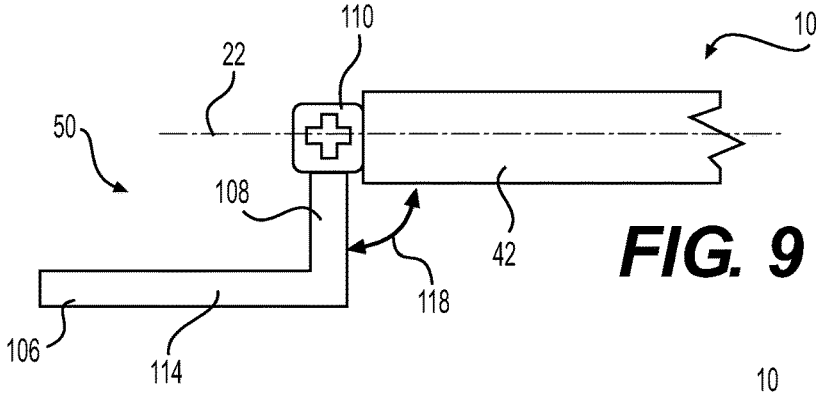
FIG. 9 is a schematic illustration of a stirrup in accordance with an embodiment of the present invention.
Figure 12:
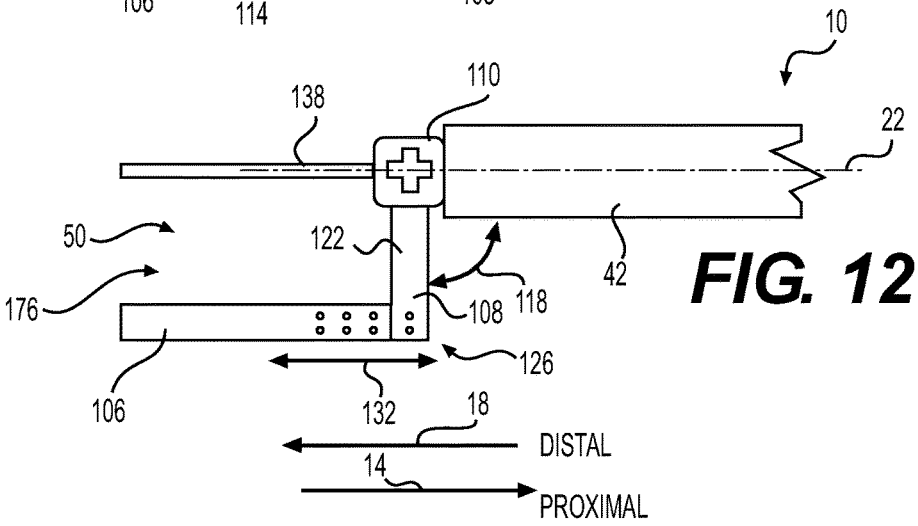
FIG. 12 is a schematic illustration of a stirrup with an arrow protector in accordance with an embodiment of the present invention.

A magnified portion of the stirrup 50 in accordance with embodiments of the invention is illustrated in FIG. 9 throughout FIG. 12. In FIG. 9, the stirrup 50 includes a first stirrup member 106, parallel with the longitudinal axis of the crossbow 10, in addition to a second stirrup member 108, connected at an angle with the first stirrup member 106, embodied in a one-part 114 configuration. The stirrup 50 is optionally pivotably secured about pivot 110 on the distal end of the crossbow 10. One can appreciate the pivotal movement 118 of the stirrup 50, 106 is limited to prevent locating the stirrup 50, 106 close to the longitudinal axis 22 of the crossbow 10. The pivotal movement 118 of the stirrup 50 on the opposite side can be sufficient to store the stirrup 50, 106 close to the foregrip 42. A locking mechanism (not illustrated) is optionally used to keep the pivotable stirrup 50, 106 in the desired position.

Figure 10:
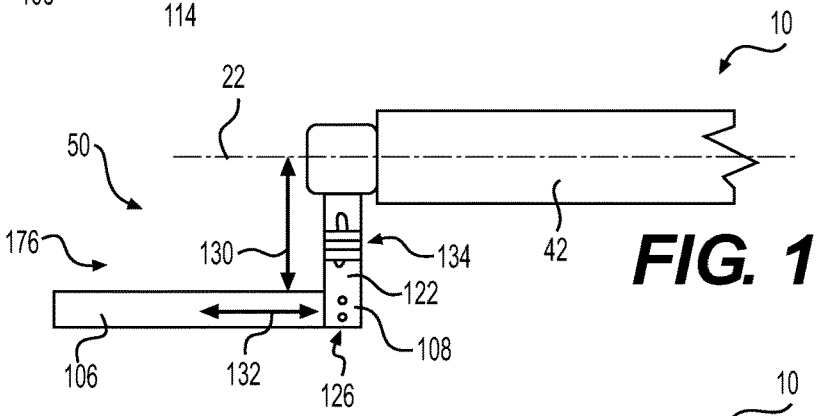
FIG. 10 is a schematic illustration of a stirrup in accordance with an embodiment of the present invention.

Moving now to FIG. 10 where is illustrated a stirrup 50 interconnected to the distal end of the crossbow 10 via the stirrup connector 122 with a securing mechanism 126. The stirrup connector 122 is sized and designed to locate the stirrup 50 at a distance 130 from the longitudinal axis 22 of the crossbow 10. The stirrup connector 122 can be sold as a retrofit part to distance and locate an OEM stirrup 50 in a desirable position thereof. The stirrup connector 122 is also optionally designed to have an adjustable length 132, between a minimum length and a maximum length, to fit a range of morphology, size of boots and user's 90 preferences. The present embodiment uses a set of spacers 134 to define the length of the stirrup connector 122 however other adjustment mechanisms are likely to become obvious to a skilled reader and remain within the scope of this application.

Figure 11:
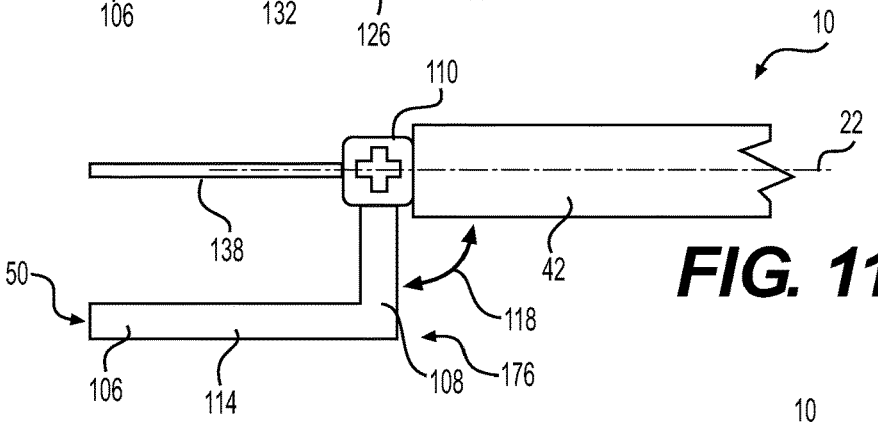
FIG. 11 is a schematic illustration of a stirrup with a foot-stopper in accordance with an embodiment of the present invention.

FIG. 11 depicts the one-part 114 stirrup 50 of FIG. 9 with an additional foot stopper 138 adapted to limit the position of the foot 98, or feet 98, in the stirrup 50 to prevent extending beyond the longitudinal axis 22. The configuration using a stirrup 50 with the foot stopper 138 is illustrated with a design where the stirrup 50 is assembled with the foot stopper 138. The longitudinal length of the first stirrup member 106 can be made with the adjustable mechanism illustrated in FIG. 12 using a series of holes 132 used in conjunction with fasteners for securing mechanism 126, however other adjustment mechanisms are likely to become obvious to a skilled reader and remain within the scope of the application.

Figure 13:
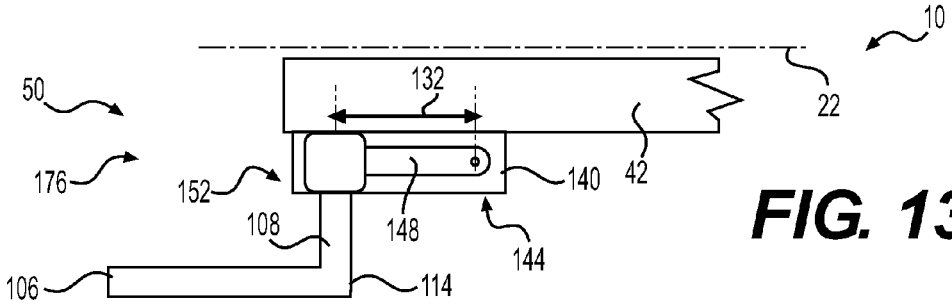
FIG. 13 is a schematic illustration of a stirrup with an adjustable stirrup support in accordance with an embodiment of the present invention.
Figure 14:
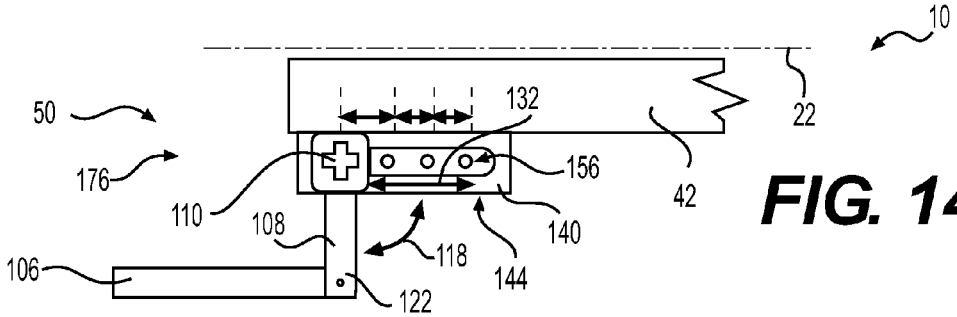
FIG. 14 is a schematic illustration of a stirrup with an adjustable stirrup support in accordance with an embodiment of the present invention.
Figure 15:
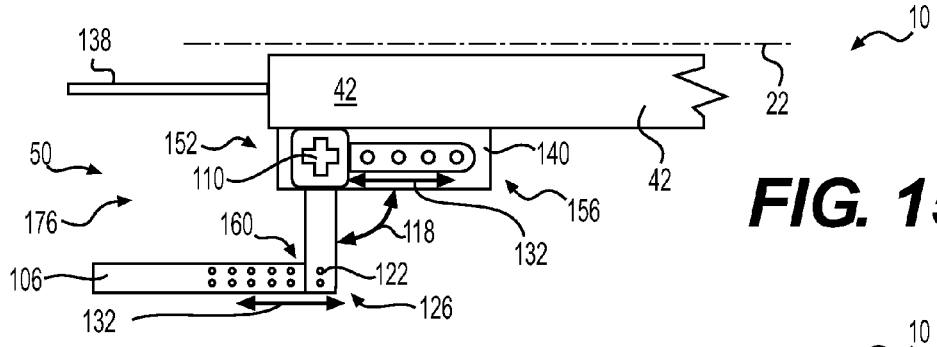
FIG. 15 is a schematic illustration of a stirrup with an adjustable stirrup support and a foot stopper in accordance with an embodiment of the present invention.
Figure 16:
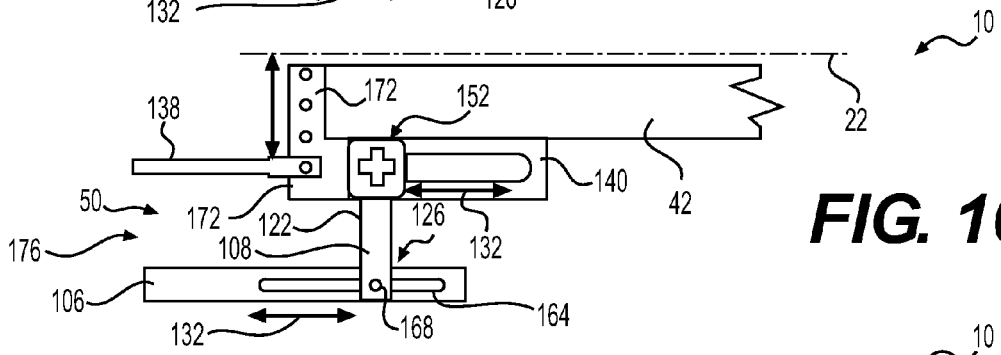
FIG. 16 is a schematic illustration of a stirrup with an adjustable stirrup support and a foot stopper in accordance with an embodiment of the present invention.

Turning now to FIG. 13 illustrating an embodiment where the stirrup 50 is adjustably secured to the crossbow 10, more precisely to the foregrip 42 of the crossbow 10 in the illustrated embodiment, via a stirrup receiver 140. The stirrup receiver 140 comprises an axial adjustment mechanism 144, embodied with a slot 148 in FIG. 13, allowing longitudinally positioning 132 of the stirrup 50 and thus modifies the length of the crossbow 10. As previously mentioned, the length of the crossbow 10 can be adapted to match different sizes of users 90 and allowing users 90 of various height to optimally cock the crossbow 10 when pulling the string 32 to more easily engage the latch 74. The slot 148 offers a variety of longitudinal positions at which can be secured the stirrup 50 with a fastener 152. The stirrup 50 can alternatively be pivotable in respect to the foregrip 42 of the crossbow 10 for storage or for reducing the length of the crossbow 10 for some other specific purposes like using the stirrup 50 as a support when shooting with the crossbow 10. The stirrup receiver 140 can alternatively offer selective positions along a predetermined length as illustrated in FIG. 14. The stirrup receiver 140 of FIG. 14 includes a series of discrete locations 156 to which the stirrup receiver 140 can be removably secured. The illustrated configuration in FIG. 14 results in the longest distance between the stirrup 50 and the crossbow 10, which is intended for tall users 90. Other adjustment mechanisms remain within the scope of this application A foot stopper 138 is added to the illustrated embodiment in FIG. 15. This time the foot stopper 138 is connected to the foregrip 42 of the crossbow 10 and is thus not going to longitudinally move with the stirrup 50. The stirrup 50 of FIG. 15 is assembled with a stirrup connector 122 to allow further adjustments thereof. In the present situation, the adjustment is discretely provided with, for example, a series of pairs of holes 160 used in conjunction with securing fasteners. Conversely, the pairs of holes 160 could alternatively be replaced with a slot 164 to provide further adjustment capabilities as illustrated in FIG. 16. A securing mechanism 168 is used to secure/fasten the first stirrup member 106 to the stirrup connector 122. One would note that the foot stopper 138 of the embodiment of FIG. 16 is connected to the stirrup receiver 140. The foot stopper 138 could be adjustably secured to a foot stopper connector 172 extending from the stirrup receiver 140 disposed on the distal end of the crossbow 10 to locate the foot stopper 138 closer, or farther, from the longitudinal axis 22 of the crossbow 10. The foot stopper 138 can alternatively be discretely secured with holes, or the like, disposed in the foot stopper connector 172. The embodiment illustrated in FIG. 17 teaches the foot stopper 138 can be secured to the stirrup 50 and be movable with the stirrup 50. All the adjustment mechanisms illustrated in FIG. 10 to FIG. 17 are preferably adapted to reduce or prevent any undesired rotations or relative movements of the parts to ensure a constant geometrical arrangement of the stirrup assembly 176.

Figure 18:
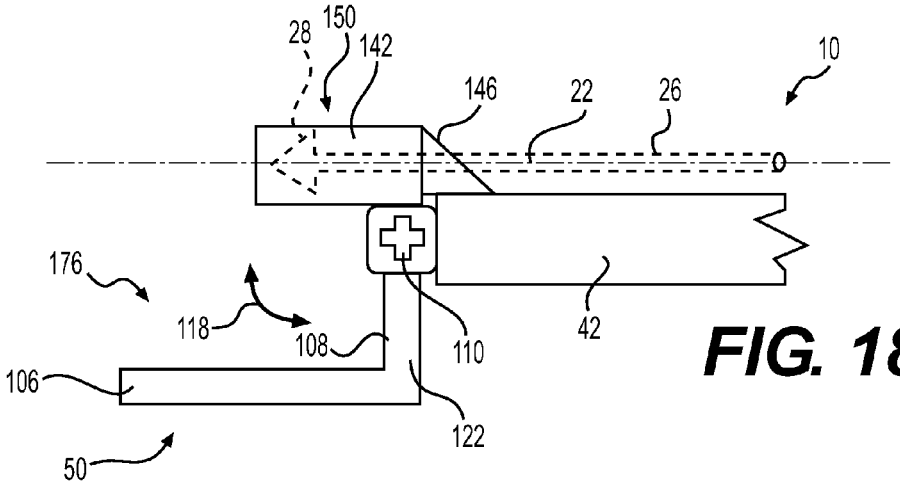
FIG. 18 is a schematic illustration of a stirrup with an arrow protector in accordance with an embodiment of the present invention.

An optional arrow protector 142, illustrated in FIG. 18, is adapted to protect the broadhead 28 of the arrow 26 against foreign objects to prevent undesirable movement of the arrow 26 and to keep the arrow 26 in line with the longitudinal axis 22. The arrow protector 142 is also helpful to prevent injuries by contacting the sharp portions of the broadhead 28. The arrow protector 142 is secured to the distal end of the crossbow 10 via a support 146, as illustrated in FIG. 18. FIG. 18 throughout FIG. 20 illustrate a stirrup assembly 176 used in conjunction with an arrow protector 142 secured to the crossbow 10 via a support 146. The arrow protector 142 receives therein a portion of the arrow 26 to maintain and secure the arrow 26 (not shown) in place on the crossbow 10. The broadhead 28, or the shaft of the arrow 26, can optionally be held by the arrow protector 142 in an embodiment. The arrow protector 142 is intended to further protect the user 90 against being injured by contacting a razor-sharp broadhead 28. The arrow protector 142 can be secured directly to the stirrup assembly 176, as illustrated in FIG. 19, and in combination with a foot stopper 138, as depicted in FIG. 20.

Figure 19:
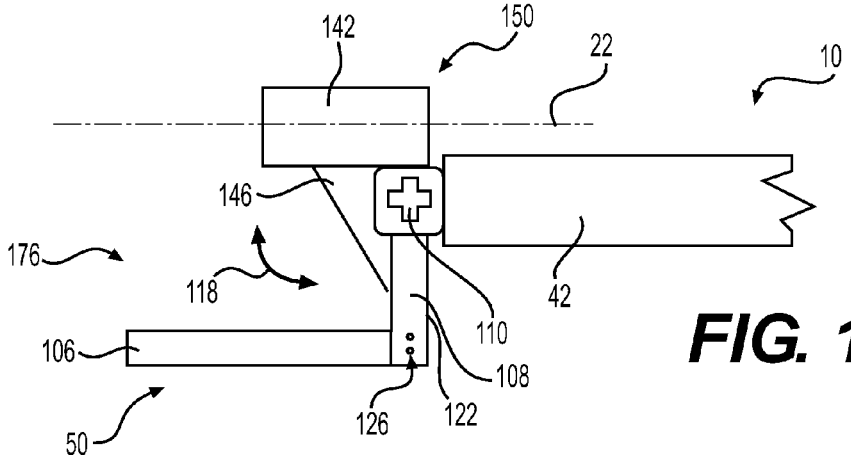
FIG. 19 is a schematic illustration of a stirrup with an arrow protector in accordance with an embodiment of the present invention.
Figure 20:
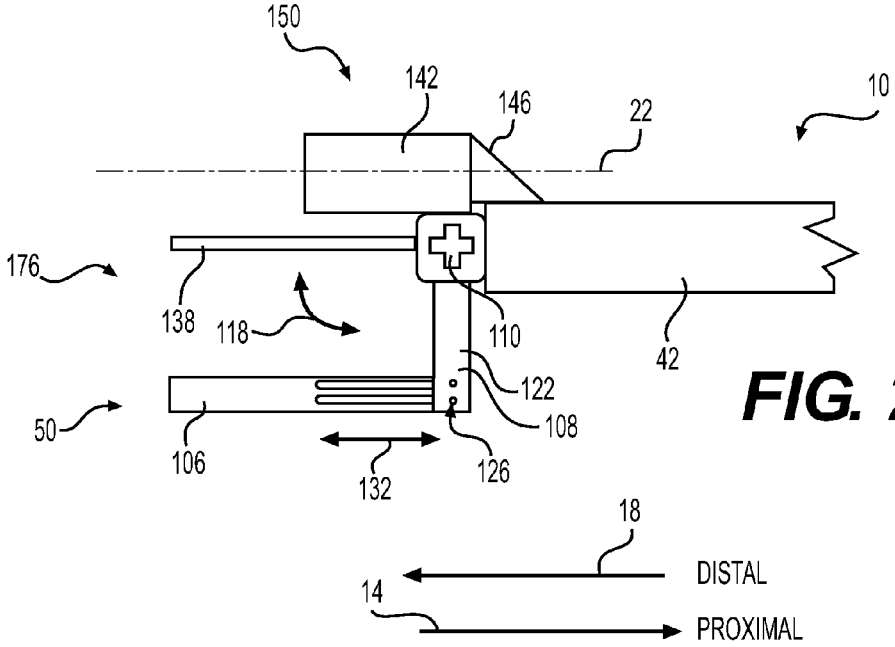
FIG. 20 is a schematic illustration of a stirrup with an arrow protector and a foot-stopper in accordance with an embodiment of the present invention.

The arrow protector 142 can alternatively be secured to the stirrup 50, 106 (or its stirrup connector 122 depending on the configuration) as exemplified in FIG. 19. The arrow protector 142 remains fix when it is connected to the distal end of the crossbow 10 and is pivotable, in its pivotable configuration, when secured to the stirrup 50, 106. The stirrup assembly 176 can alternatively be used in cooperation with the arrow protector 142 as embodied in FIG. 20.

Figure 21:
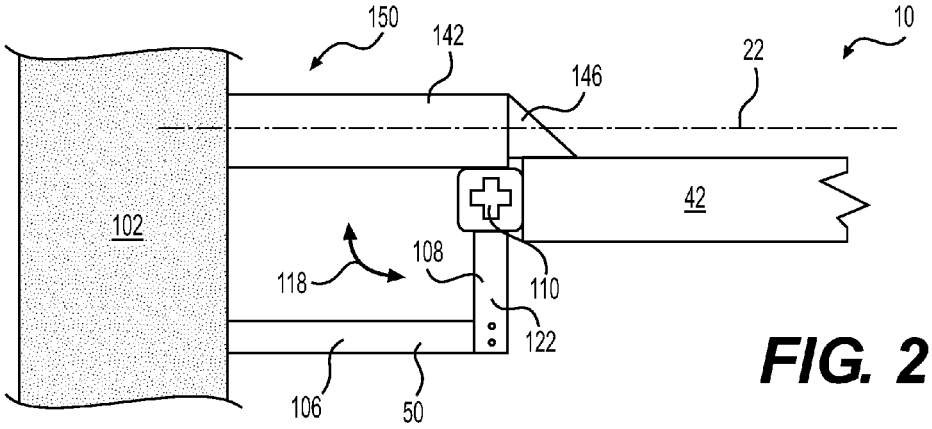
FIG. 21 is a schematic illustration of a stirrup with an arrow protector adapted to contact the ground in accordance with an embodiment of the present invention.
Figure 22:
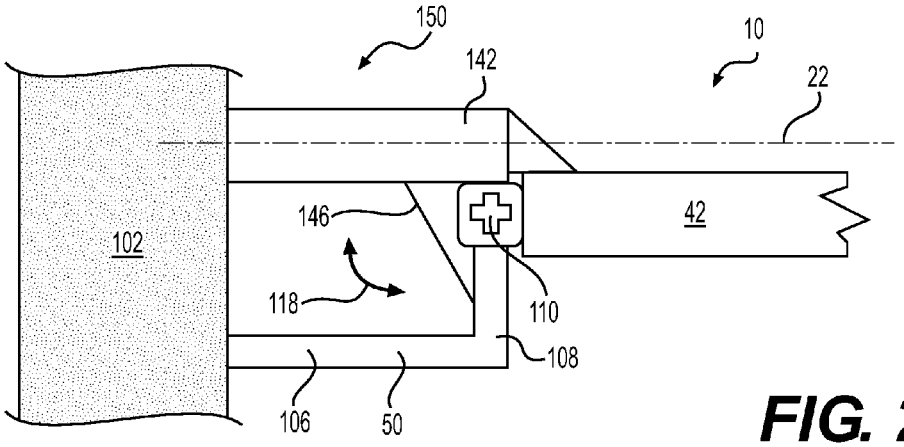
FIG. 22 is a schematic illustration of an arrow protector adapted to contact the ground in accordance with an embodiment of the present invention.
Figure 23:
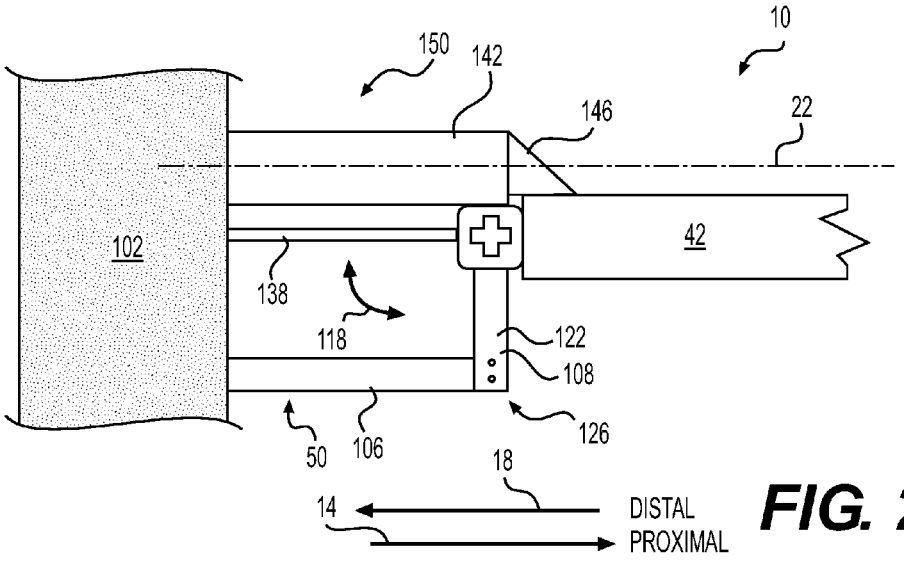
FIG. 23 is a schematic illustration of a stirrup with an arrow protector and a foot-stopper adapted to contact the ground in accordance with an embodiment of the present invention.

A longer arrow protector 142 can be used to increase the crossbow 10 stability when positioned vertically in contact with the ground 102 for cocking the string 32 of the crossbow 10 or simply for vertically resting the crossbow 10 on the ground. As it is exemplified in FIG. 21 through FIG. 23, various combinations and arrangements of parts are possible. The arrow protector 142 offers an additional point of contact with the ground 102 to increase the stability of the crossbow 10. With the embodied "T" shaped stirrup 50, the arrow protector 142 produces a three-contact-point (or triangular) support on the ground to ensure self-stability, or mechanical equilibrium, of the crossbow 10 resting on its distal end thereof. Preferably, the stirrup assembly 176 and the arrow protector 142 are collectively configurable to ensure they are of a proper length to be usable together.

Figure 24:
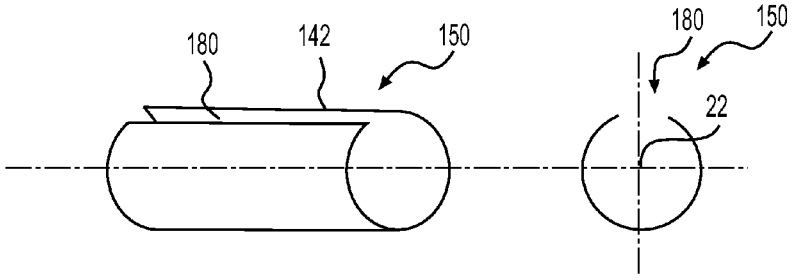
FIG. 24 is a schematic illustration of an arrow protector in accordance with an embodiment of the present invention.
Figure 25:
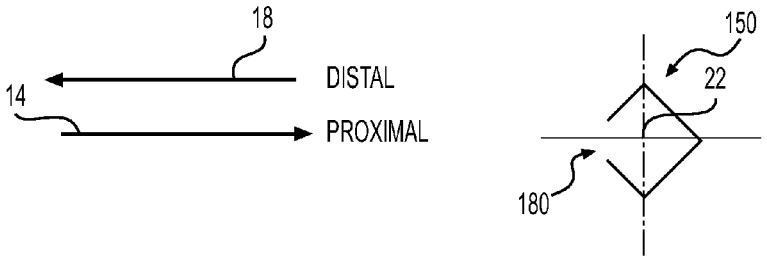
FIG. 25 is a schematic illustration of an arrow protector in accordance with an embodiment of the present invention.
Figure 26:
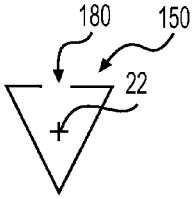
FIG. 26 is a schematic illustration of an arrow protector in accordance with an embodiment of the present invention.
Figure 27:
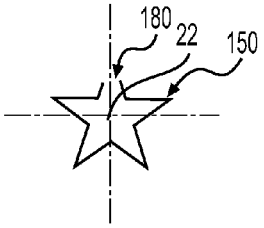
FIG. 27 is a schematic illustration of an arrow protector in accordance with an embodiment of the present invention.
Figure 28:
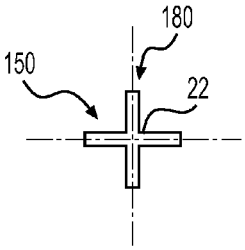
FIG. 28 is a schematic illustration of an arrow protector in accordance with an embodiment of the present invention.

FIG. 24 throughout FIG. 28 schematically illustrate variants of possible arrow protector 142 shapes 150. The section views depict different shapes, sized and designed to accommodate different types and sizes of arrow heads, and thus ensure optimal positioning of the arrow 26 in addition to protect the sharp tip broadhead 28 of the arrow 26. An opening 180 in the arrow protector 142 can be provided to pass the arrow 26, preferably the shaft of the arrow 26, through the arrow protector 142 as opposed to require slipping broadhead 28 of the arrow 26 longitudinally through the arrow protector 142. Simply passing the arrow shaft through the opening 180 in the arrow protector 142 is a more natural movement for the user 90.

Figures 29, 30, 31:
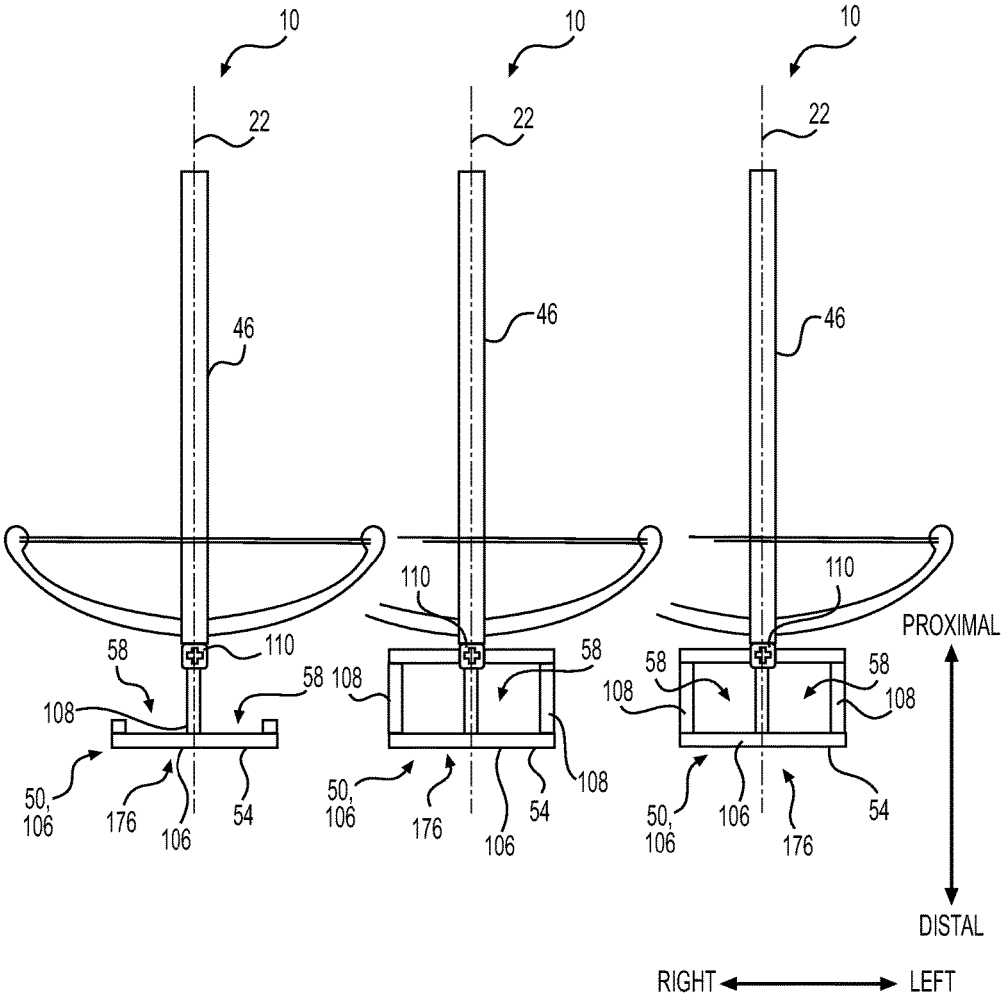
FIG. 29 is a schematic illustration of a top plan view of a crossbow with a stirrup in accordance with an embodiment of the present invention.
FIG. 30 is a schematic illustration of a top plan view of a crossbow with a stirrup in accordance with an embodiment of the present invention.
FIG. 31 is a schematic illustration of a top plan view of a crossbow with a stirrup in accordance with an embodiment of the present invention.

In turn, FIG. 29 throughout FIG. 31 illustrate stirrups 50, 106 adapted to accommodate one foot 98 or two feet 98 therein using different arrangements of parts. The embodiment exemplified in FIG. 29 illustrates a pair of opened foot-receiving portions 58. FIG. 30 illustrates an embodiment where one foot 98 or two feet 98 can be inserted in the foot-receiving portion 58. The foot-receiving portion 58 of FIG. 30 is separated in the embodiment of FIG. 31 to ensure a more precise position of both feet 98 in the stirrup assembly 176. Those arrangements configured to accommodate two feet 98 have the benefit, inter alia, to provide additional stability to the crossbow 10. The two feet 98 are in a position to exercise an equal pressure on both sides of the longitudinal axis 22 via the stirrup assembly 176. The crossbow 10 is thus firmly maintained on the ground and into a stable and balanced position. Another benefit is to make it possible for user to cock the crossbow 10 in a seated posture.

Figure 32:
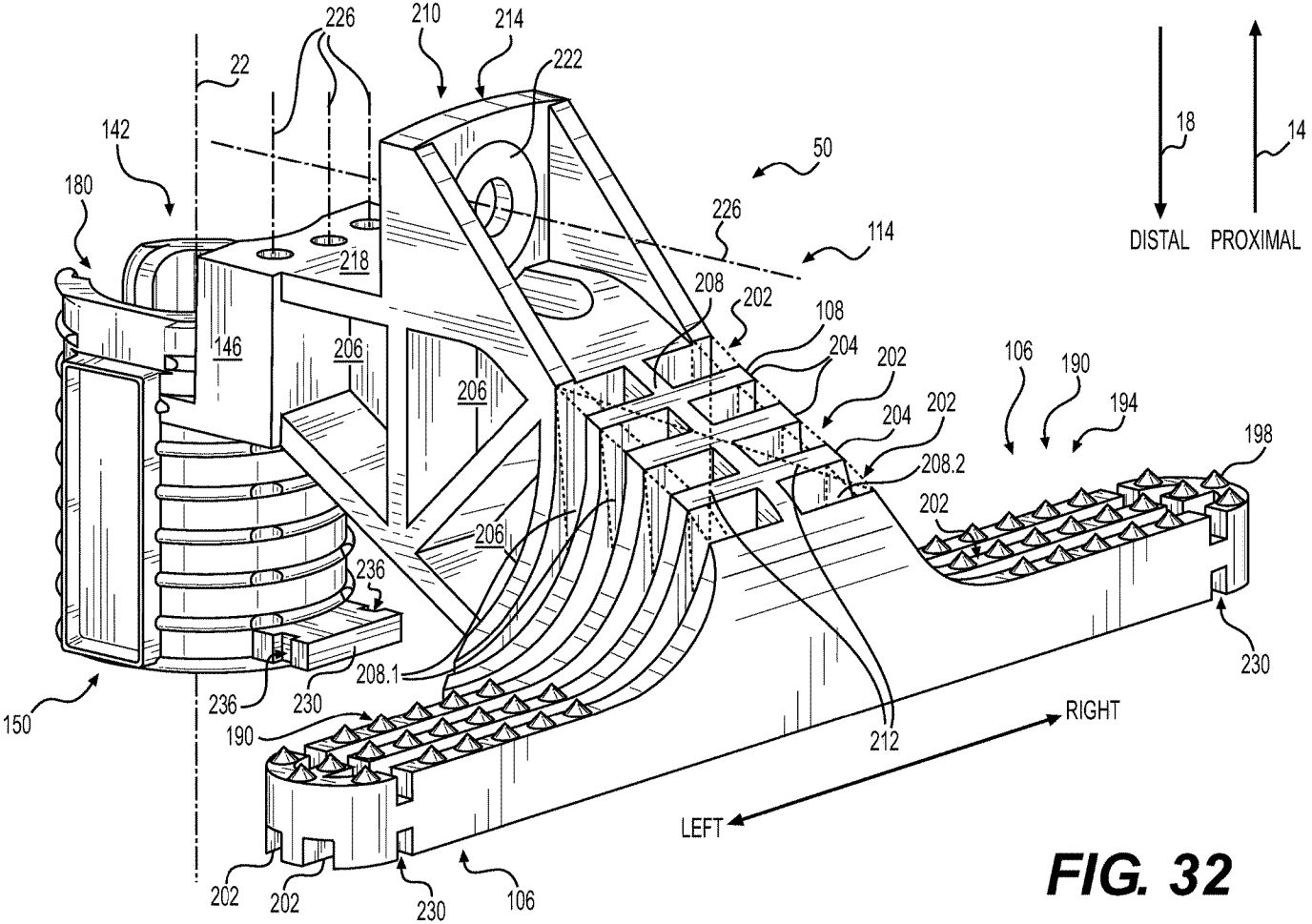
FIG. 32 is an isometric view of an exemplary stirrup in accordance with an embodiment of the present invention.
Figure 38:
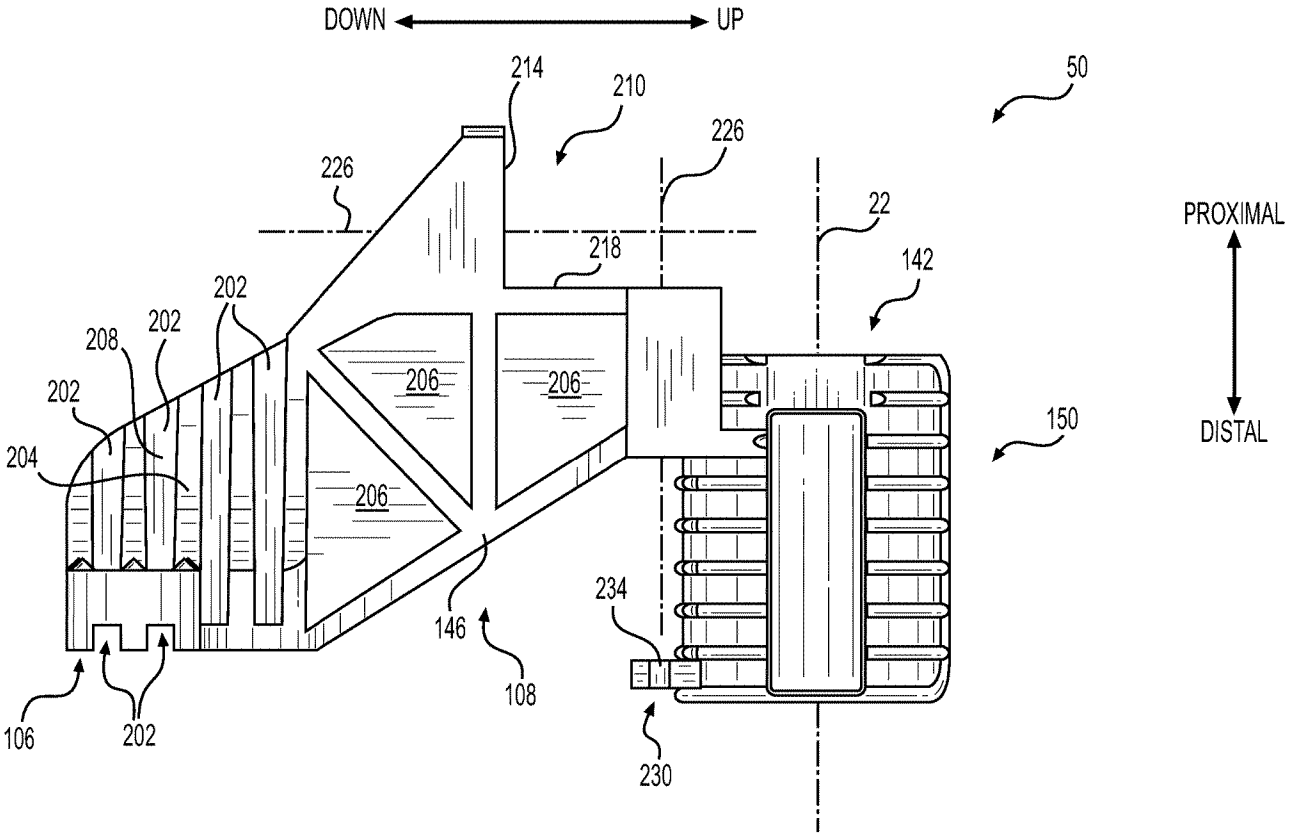
FIG. 38 is a right elevational view of an exemplary stirrup in accordance with an embodiment of the present invention.

The previous Figures have been illustrating embodiments in a rather conceptual fashion. FIG. 32 throughout FIG. 38 are illustrating a more refined embodiment of the stirrup 50. The embodied stirrup 50 of FIG. 32 is made in a one-piece configuration with injected material. The polymer material is can also include fibers therein to further reinforce the stirrup 50 or elements thereof. The polymer material offers several advantages, namely in terms of lightweight, low price for mass production of the stirrup 50 and also as a vibration dampening element. Alternatively, other materials like aluminum could be used to manufacture the stirrup 50. The stirrup 50 illustrated in FIG. 32 includes two open foot-receiving portions 190 disposed on lateral sides of the longitudinal axis 22 locating the feet 98 of a user away from the trajectory of the arrow 26. The two foot-receiving portions 190 of the stirrup 50 are equipped with anti-slip features 194 embodied as an array of molded small spikes 198. The foot-receiving portions 190 further include grooved sections 202 adapted to ensure a strong contact between the stirrup 50 and the feet 98 of a user on one side and the ground 102 on the opposite side when the stirrup 50 is in the cocking position. The grooved sections 202 are also extending in the second stirrup member 108 to lighten the stirrup 50 by using material discretely where required for mechanical strength. A series of ribs 204 are interconnected by a junction rib 208 to increase the stiffness of the stirrup 50. A plurality of parallel junction ribs 208.1, 208.2, illustrated in dotted lines, could be embodied to increase the stiffness of the part. Other patterns of ribs 204 and junction ribs 208 could be used to provide the desired stiffness and mechanical strength to the stirrup 50. A pattern of junction ribs in "X" 212 schematically illustrated with dotted lines could be used to add torsion stiffness. One can note that the second stirrup member 108 also includes recessed sections 206 to further lighten the stirrup 50 by using material discretely where required for mechanical strength between the foot-receiving portions 190, the arrow protector 142 and the crossbow 10.

The stirrup 50 includes an optional arrow protector 142 that is covering the broadhead 28 of the arrow 26 hence further protecting the feet 98 of a user 90 from the broadhead 28 of the arrow 26. The stirrup 50 can be embodied with only the foot-receiving portions 190 and, alternatively, with the arrow protector 142. The arrow protector 142 can optionally be a distinct part and be added if desired to the stirrup 50. The longitudinal length of the arrow protector 142 preferably covers the broadhead 28. The position, configuration and length of the arrow protector 142 is providing a third contact point with the ground in addition with the two contact points with the ground offered by the two foot-receiving portions 190. This layout produces a triangular ground-contacting configuration with three contact points providing stability of the crossbow 10 when resting on the ground on its distal side, supported by the stirrup 50 and the arrow protector 142 for cocking the crossbow 10.

The stirrup 50 further includes a crossbow receiving portion 210 adapted for contacting and attaching the stirrup 50 to the distal end of the crossbow 10 with two cooperating angled planes 214, 218 (illustrated orthogonal to each other) ensuring a strong connection with the crossbow 10. The plane 214 can include a reinforcing sleeve 222 providing additional strength to the stirrup when the fastener is secured therethrough. The reinforcing sleeve 222 can be made of aluminum or other materials offering sufficient strength. Fasteners are used to secure the stirrup 50 to the crossbow 10 through a series of holes 226.

Figure 33:
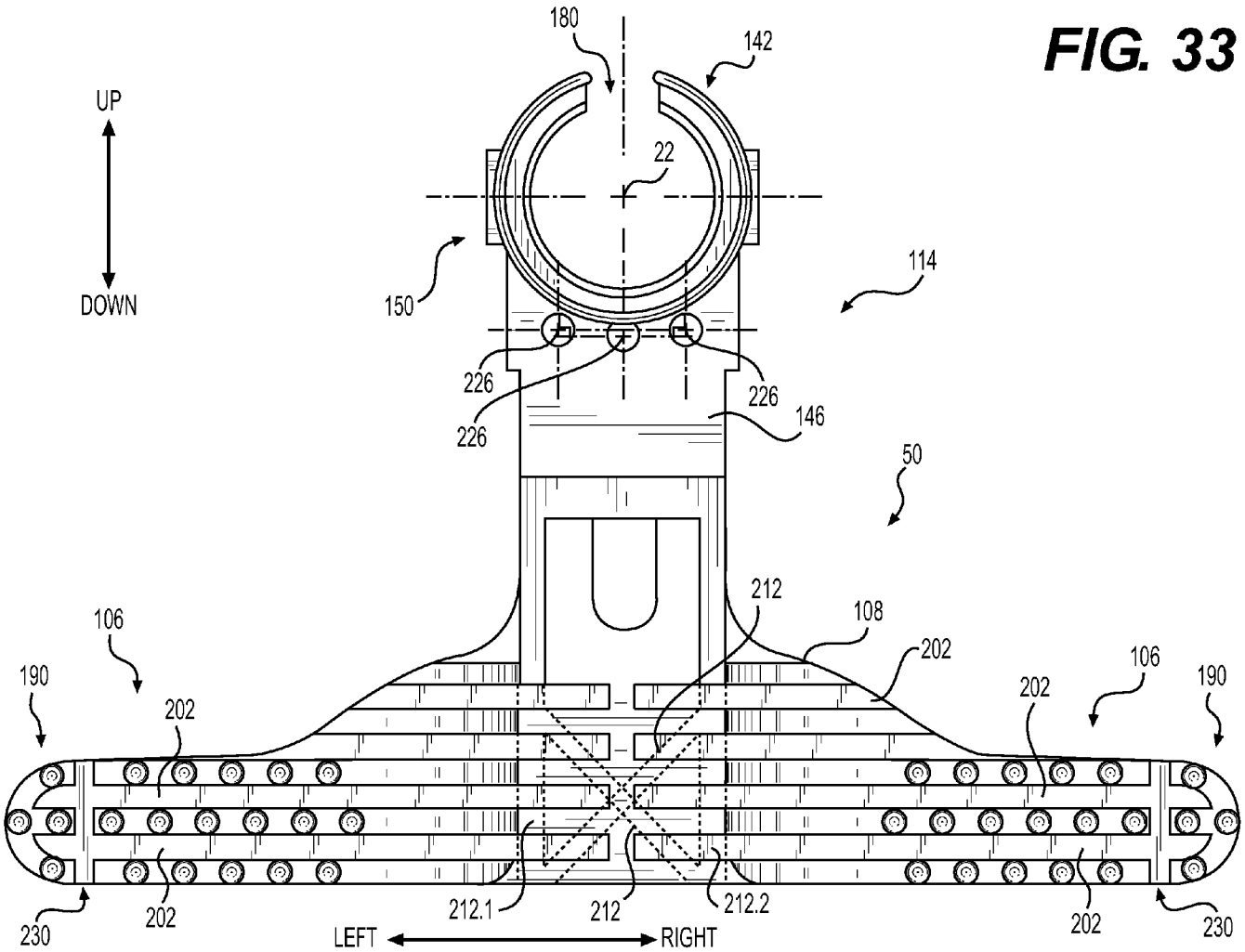
FIG. 33 is a top plan view of an exemplary stirrup in accordance with an embodiment of the present invention.
Figure 34:
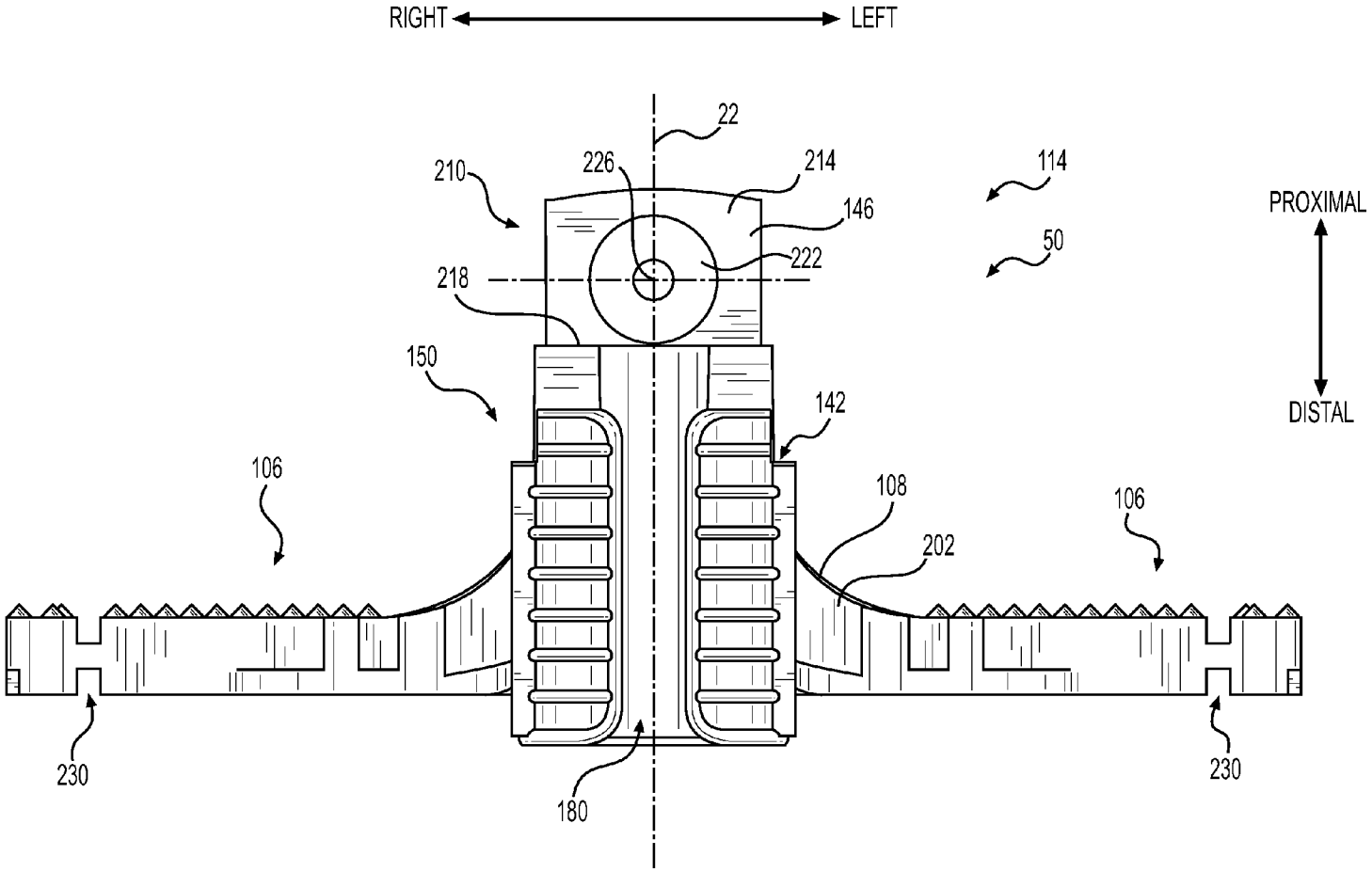
FIG. 34 is a front elevational view of an exemplary stirrup in accordance with an embodiment of the present invention.
Figure 35:
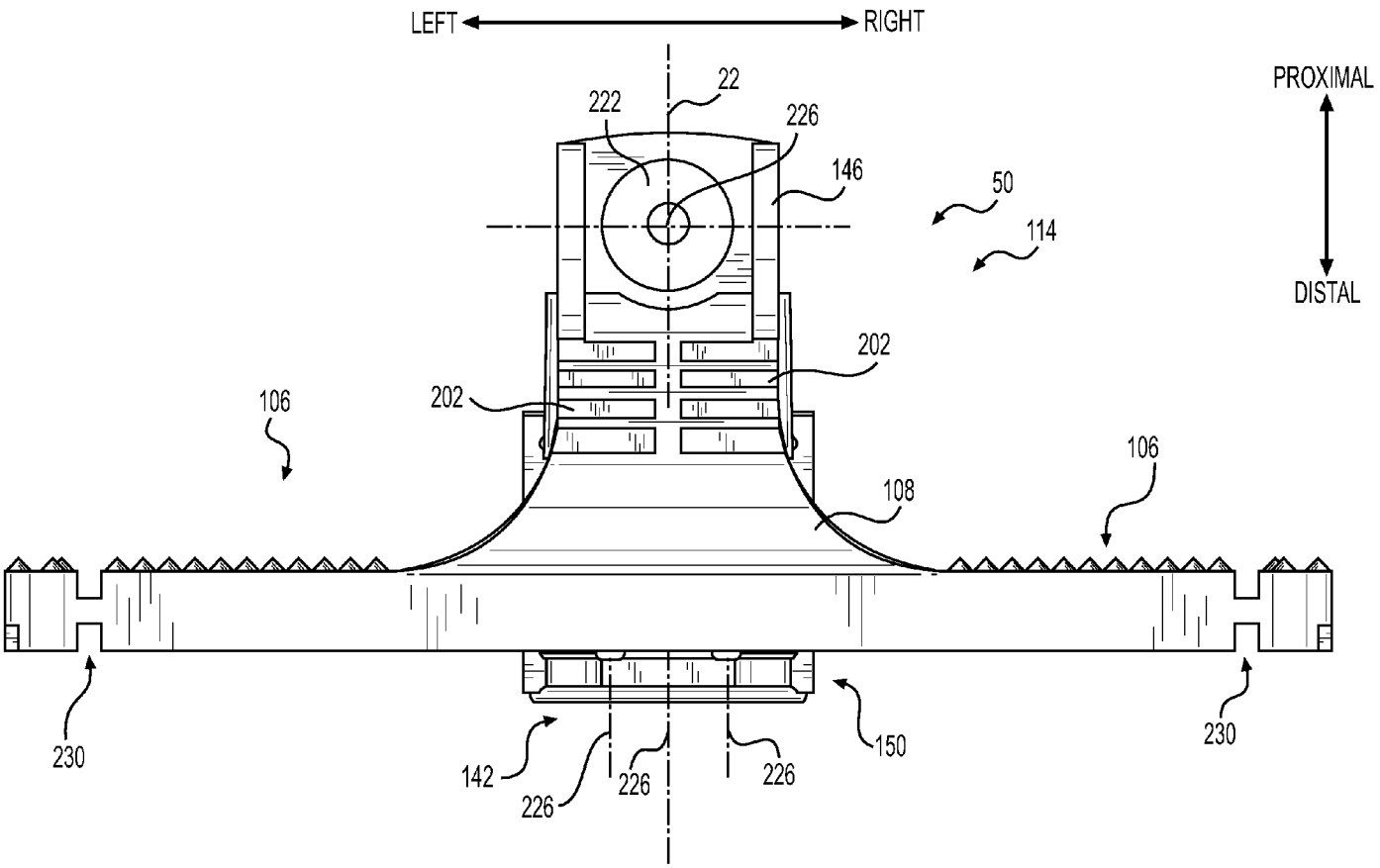
FIG. 35 is a rear elevational view of an exemplary stirrup in accordance with an embodiment of the present invention.
Figure 36:
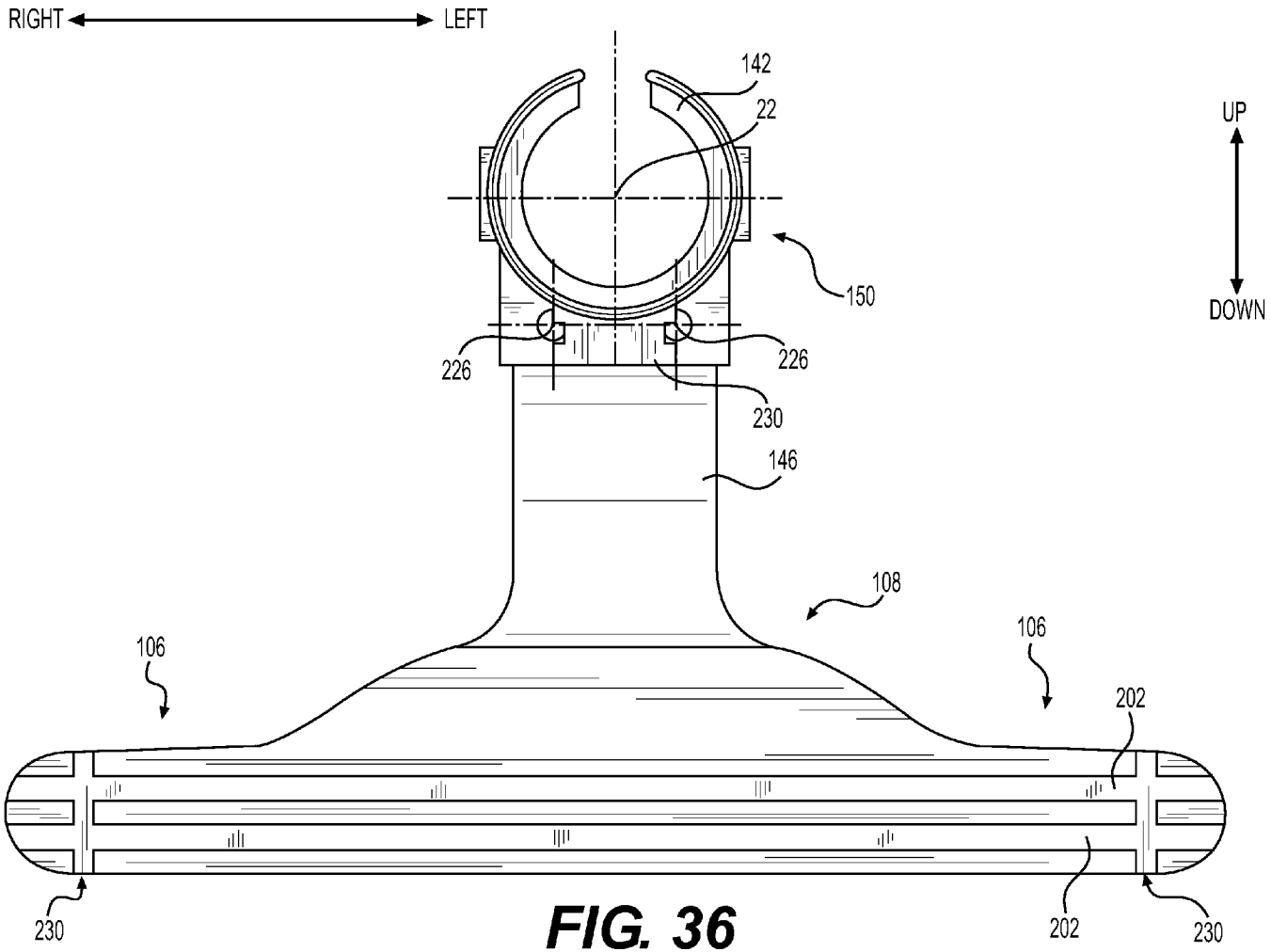
FIG. 36 is a bottom plan elevational view of an exemplary stirrup in accordance with an embodiment of the present invention.
Figure 37:
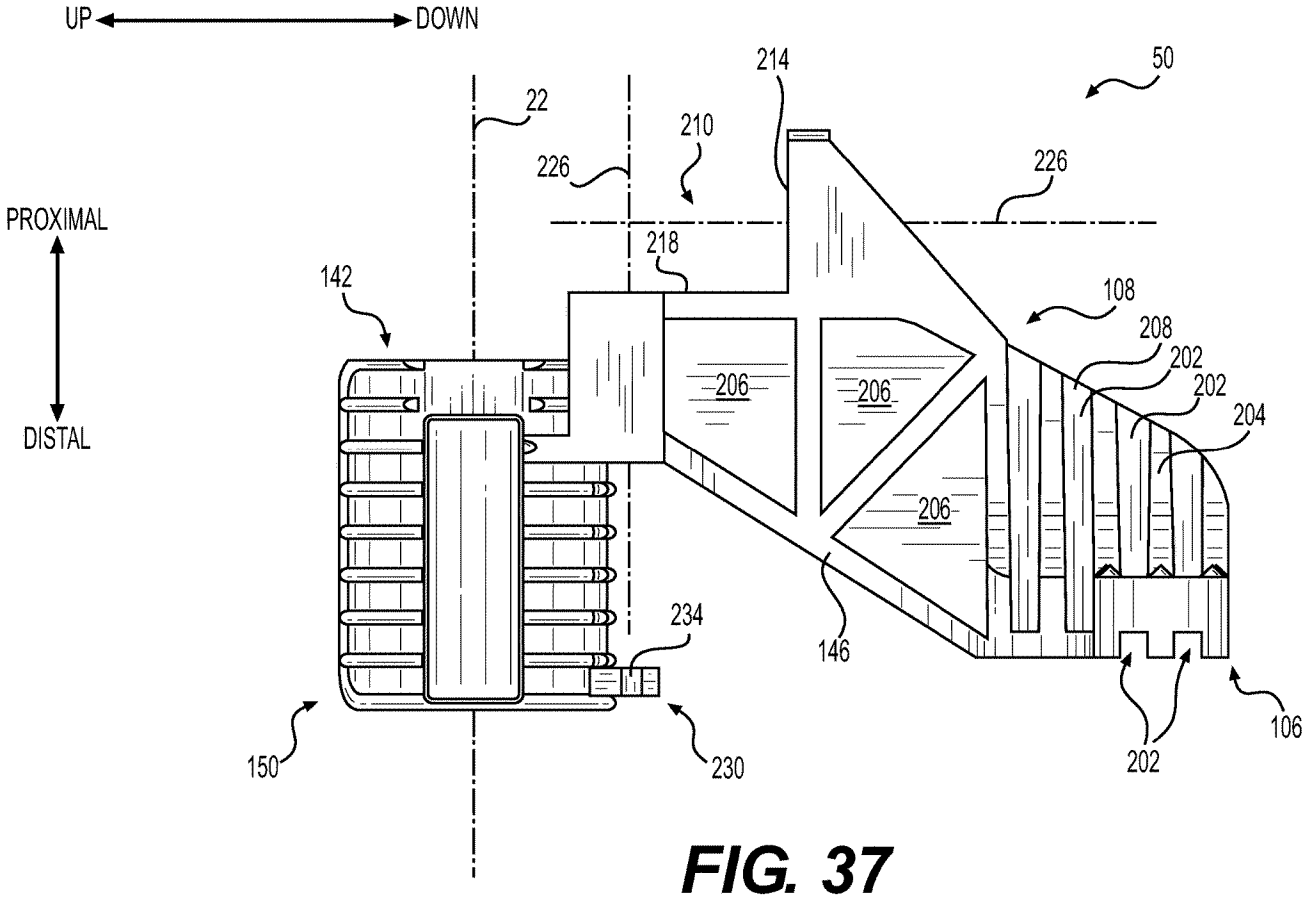
FIG. 37 is a left elevational view of an exemplary stirrup in accordance with an embodiment of the present invention.

Crossbows 10 are generating significant vibrations when releasing the string 32 for propelling an arrow 26. However, a low level of noise is preferable when hunting. The stirrup 50, seen in FIG. 32 throughout FIG. 38, includes a plurality of vibration damper receivers 230. The vibration damper receivers 230 are sized and designed to receive vibration dampers 234 thereon. In a possible embodiment, rubberized elements 238 can be used as vibration dampers and be installed on the stirrup 50. In the present embodiment, the vibration damper receivers 230 are located near the ends of the foot-receiving portions 106 to dissipate vibrations traveling toward the ends of the foot-receiving portions 106 before they transform into audible noise. A third vibration damper receiver 230 is located in the center of the stirrup 50 between the arrow protector 142 and the foot-receiving portions 106, preferably near the end of the arrow protector 142. The vibration dampers are going to be secured within the groove shaped by the vibration damper receivers 230 in the foot-receiving portions 190. The third vibration damper receiver 230 is embodied as a protrusion extending from the arrow protector 142 including concave sections sized and designed to receive therein a vibration damper 234. It remains within the scope of the present application to add, remove and change the configuration, the number and the locations of the vibration damper receivers 230 to adapt to specific factors and designs. From FIG. 33, one can appreciate that the laterally disposed foot-receiving portions 190 are distanced from the arrow trajectory 22 by about 100 mm in the vertical direction, more precisely, by more than 110 mm and in some circumstances by more than 120 mm. Generally, the preferred configuration of the stirrup 50 renders rather impossible to place a foot or two feet in the trajectory 22 of the arrow 26. The feet are located away from the trajectory of the arrow 26 and should that not be enough, the support 146 and the arrow protector 142 are physically preventing a foot on the foot-receiving portion 190 to get in interference with the trajectory 22 of the arrow 26.

Figure 39:
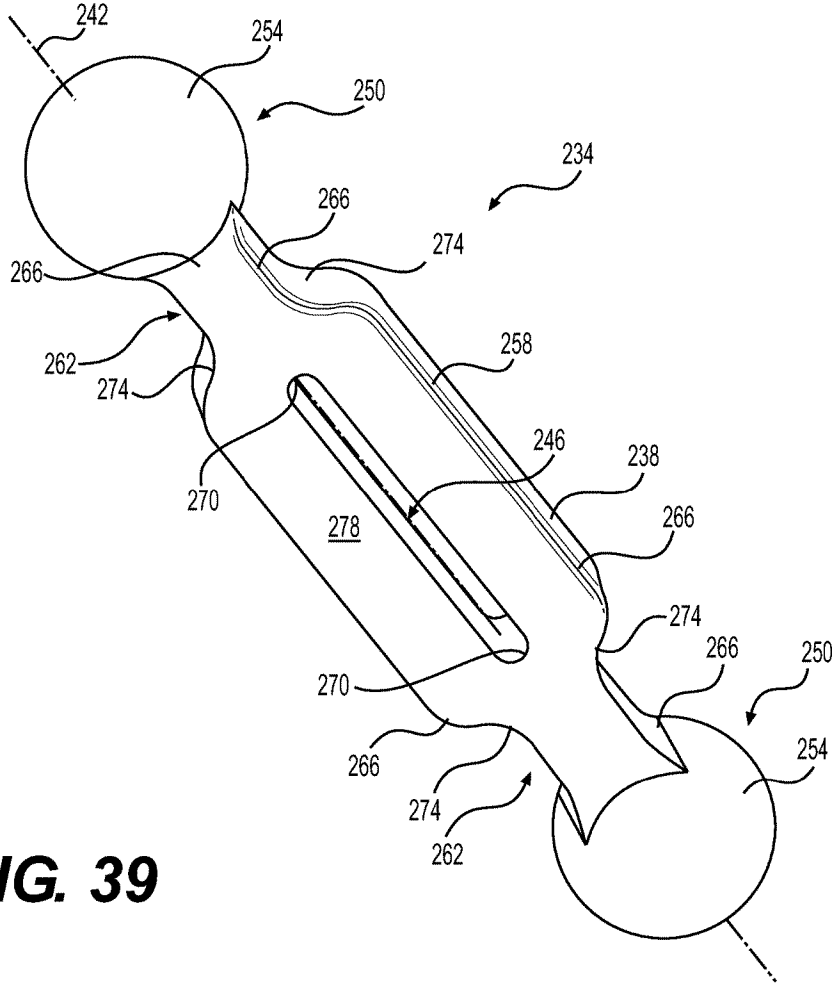
FIG. 39 is an isometric view of an exemplary vibration damper in accordance with an embodiment of the present invention.
Figure 40:
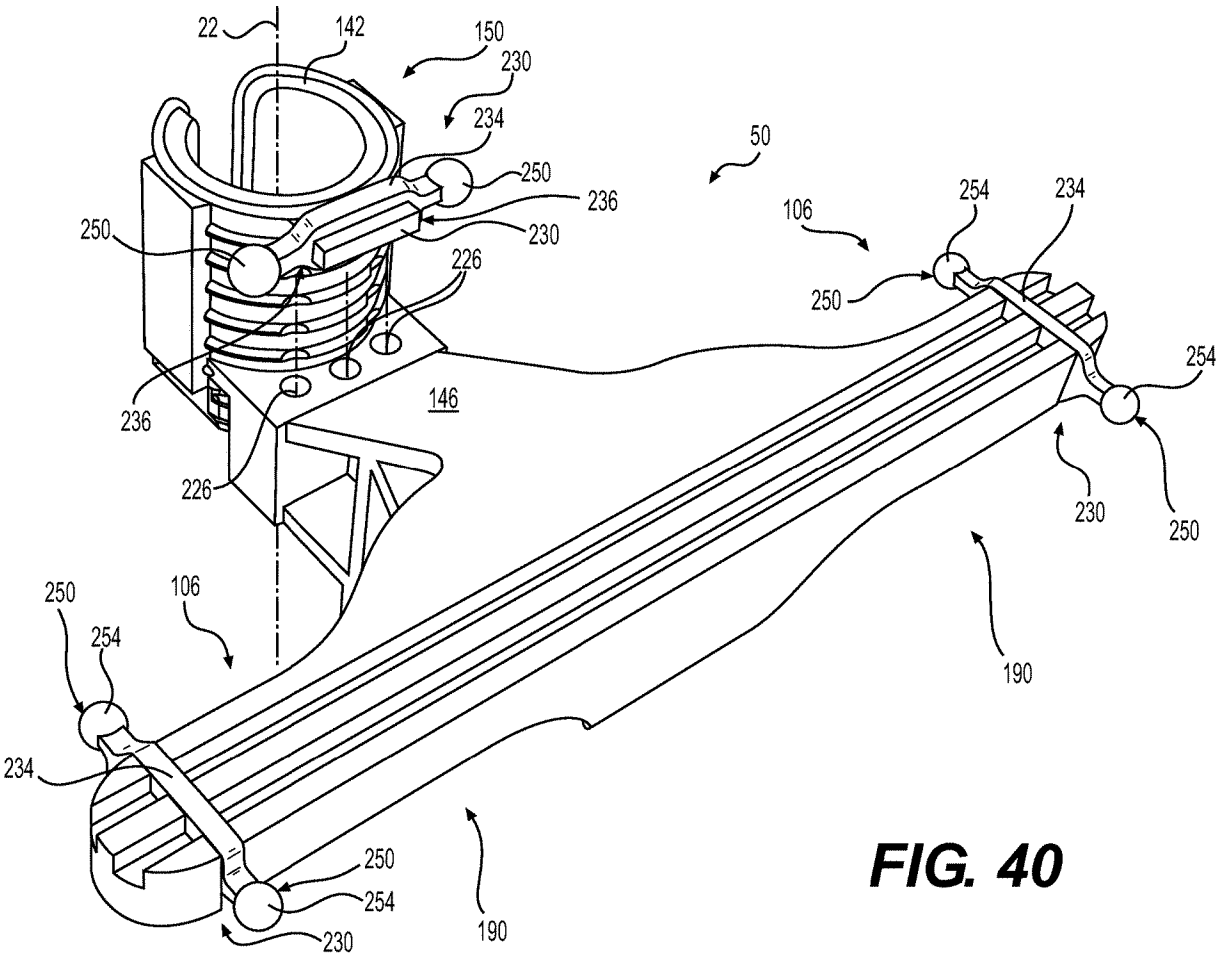
FIG. 40 is an isometric view of an exemplary stirrup outfitted with several exemplary vibration dampers in accordance with an embodiment of the present invention.

A vibration damper 234 is exemplified in FIG. 39. The vibration damper 234 is preferably made of vibrations dampening material like rubber. The vibration damper 234 is designed with an elongated shape along a longitudinal axis 242. The vibration damper 234 can be embodied in various longitudinal lengths in accordance with its position on the stirrup 50 or on the crossbow 10. A soft rubber having sufficient elasticity is preferable to ensure strong contact and proper positioning on the stirrup 50 or the crossbow 10. The contact with the stirrup 50 or the crossbow 10 needs to be sufficient to prevent any change of location when the vibration damper 234 is subjected to vibrations.

The vibration damper 234 includes a central opening 246 that is sized and designed to fit on the desired vibration damper receivers 230. The central opening 246 is illustrated with a longitudinal shape adapted to match and properly cooperate with the vibration damper receivers 230 of the illustrated embodiment. At least one protruding portion 250 is axially extending on at least one side of the vibration damper 234 to vibrate and dissipate vibration energy with its flexible construction and lower the vibration noise that could be caused by the release of the tension in the string 32 and the propulsion of the arrow 26. The protruding portion 250 is embodied at a distance from the central opening 246 with a spherical shape 254. The protruding portion 250 is connected with the body 258 of the vibration damper 234 by an interconnecting portion 262. The interconnecting portion 262 has a reduced section compared with the body to transmit vibrations to the vibration damper 234. In turn, the vibration damper 234 has a larger size to include more material ensuring efficient vibration absorption. The vibration damper 234 is embodied as a generally spherical shape 254 in the present embodiment however other shapes and sizes are contemplated by the present application.

A series of radiuses 266 are managing soft transitions between the different sides of the vibration damper 234. A radius 270 is included on each longitudinal extremity of the central opening 246 to prevent local stress concentration. External radiuses 274 are disposed between the body 258. Opposed and substantially planar sides 278 are defining the lateral shape of the vibration damper 234. The thickness of the body 258 is adapted to match the thickness of the vibration damper receiver 230 and the elasticity of the vibration damper 234 allows installation of the vibration damper 234 thereon while firmly securing the vibration damper 234 on the desired vibrating portion of the stirrup 50 and/or the crossbow 10.

The combined interaction between the stirrup 50 disposed at a distal 18 end of the crossbow 10 is acting as an energy harvesting structure that can harvest energy from the vibrations caused by the functioning of the crossbow 10. The harvesting of mechanical energy from vibrations is using inertial energy harvesting that generally relies in the resistance of a mass to acceleration, and kinematic energy harvesting which directly couples the energy harvester, the stirrup 50, to the relative movement of the source, the crossbow 10. The polymer stirrup 50 of embodiments therein is mainly provided by the viscoelastic character of polymers. Rubber is also used as vibration damping material due to its viscoelasticity.

Figure 41:
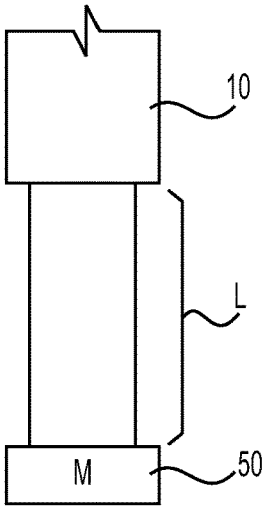
FIG. 41 is a schematic illustration of a mass-ended cantilevered beam in accordance with an embodiment of the present invention.
Figure 42:
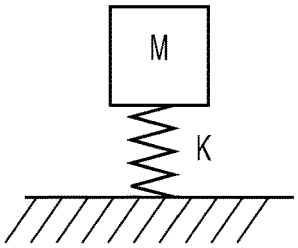
FIG. 42 is a schematic illustration of a mass-ended cantilevered beam treated as a simple lumped-mass sdof (single degree of freedom) system in accordance with an embodiment of the present invention.
Figure 43:
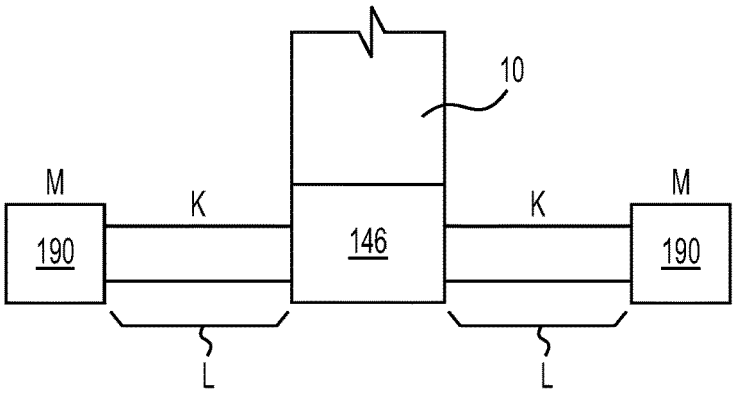
FIG. 43 is a schematic illustration of the conceptual vibration absorber refined to consider the two feet-receiving portions as cantilever vibration absorbers of an exemplary stirrup in accordance with an embodiment of the present invention.

The stirrup 50 and crossbow 10 structure can be seen as a spring designs for use in vibration absorbers. In particular, the "mass-ended cantilevered" produced by the foot-receiving portions 190 extending distally in front of the crossbow 10, offers a very simple realization of a spring-mass system for use as a vibration absorber. Such a mass-ended cantilevered beam is illustrated schematically in FIG. 41 where the cantilever stirrup 50 is connected to the crossbow 10. The hence considered mass-ended cantilevered beam may be treated as a simple lumped-mass sdof (single degree of freedom) system as shown in FIG. 42 having a mass M and a spring stiffness K. The conceptual vibration absorber can also be refined to consider the two foot-receiving portions 190 extending distally in front of the crossbow 10 as illustrated in FIG. 43 as cantilever vibration absorber.

The exemplified stirrup 50 is preferably made of polymer material that can be charged with reinforcement fibers therein to further increase its mechanical strength due to the significant mechanical load applied on the stirrup 50 when cocking the crossbow 10. The type of material can be altered to obtain precise vibration absorption properties. The type of reinforcement fibers and the amount added in an injected material are also variables adapted to be set to obtain a precise vibration absorption behavior. In embodiments of the invention, the polymer can be selected from the following: Nylon, Acrylic and ABS. A preferred embodiment uses Nylon (Nylene 4114-14 HSL PA-66) with about 15% fibers therein. Other recipes can be used to provide sufficient mechanical properties without departing from the scope of the invention.

Figure 44:
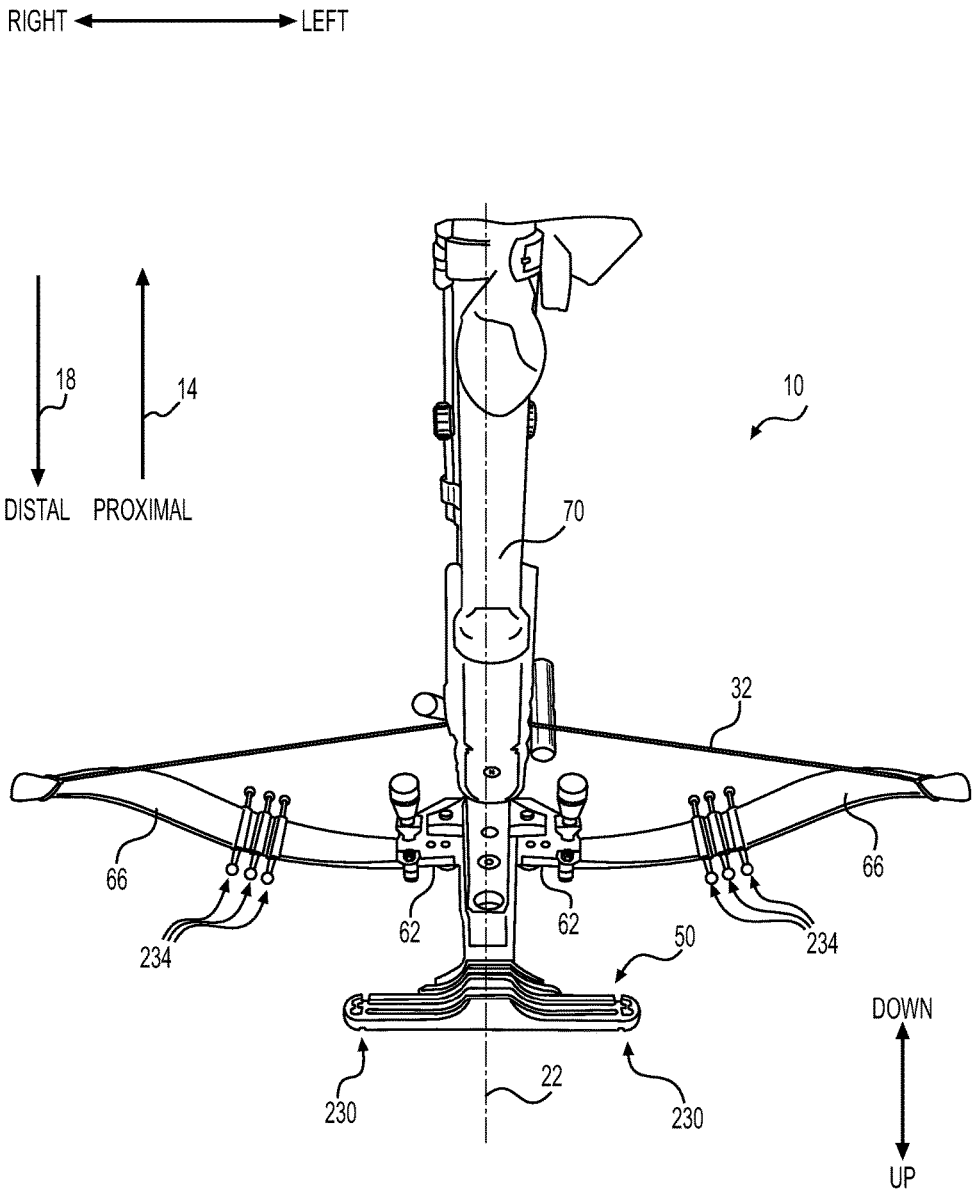
FIG. 44 is a bottom isometric view of a stirrup attached to a crossbow in accordance with an embodiment of the present invention.
Figure 45:
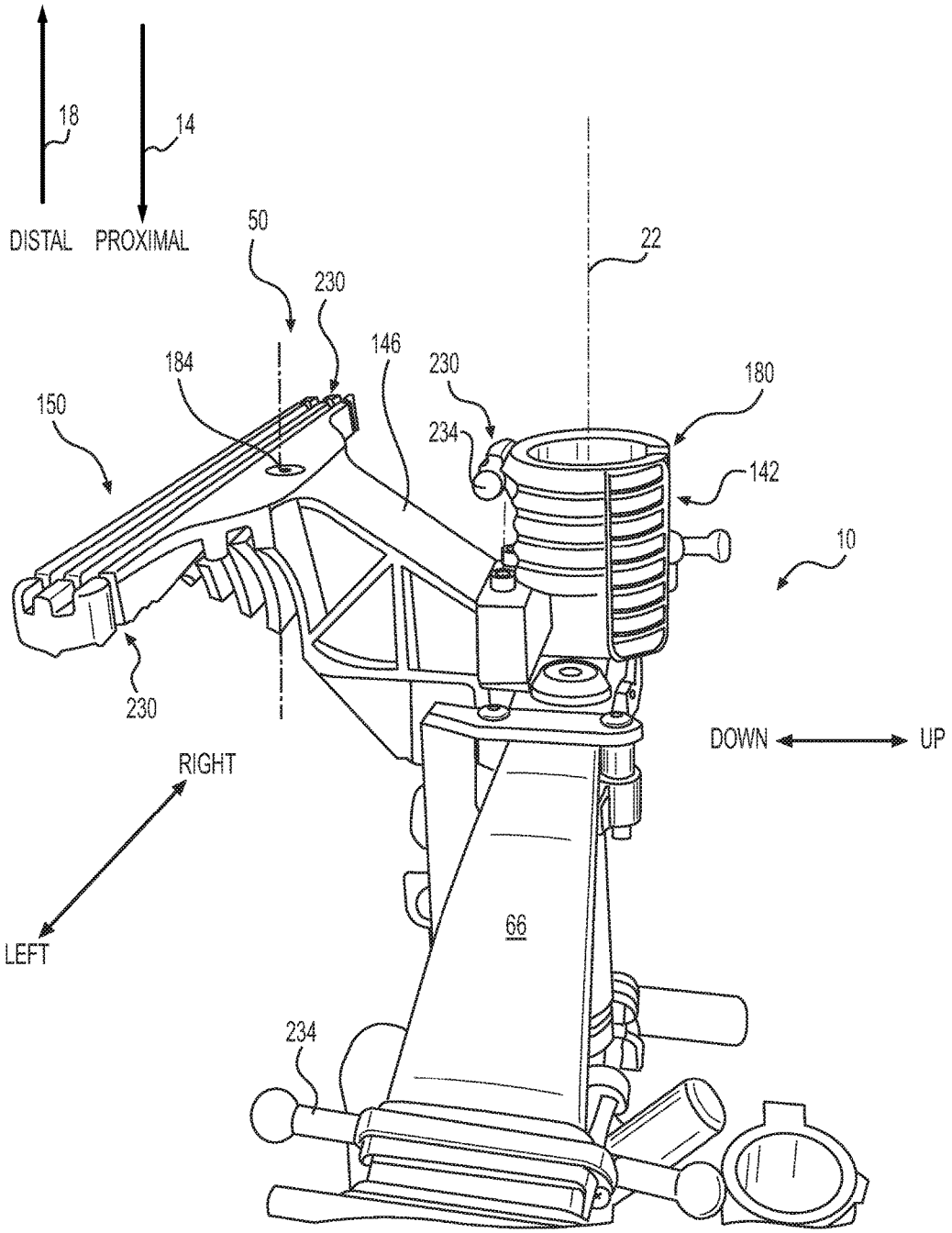
FIG. 45 is a left isometric view of a stirrup attached to a crossbow in accordance with an embodiment of the present invention.
Figure 46:
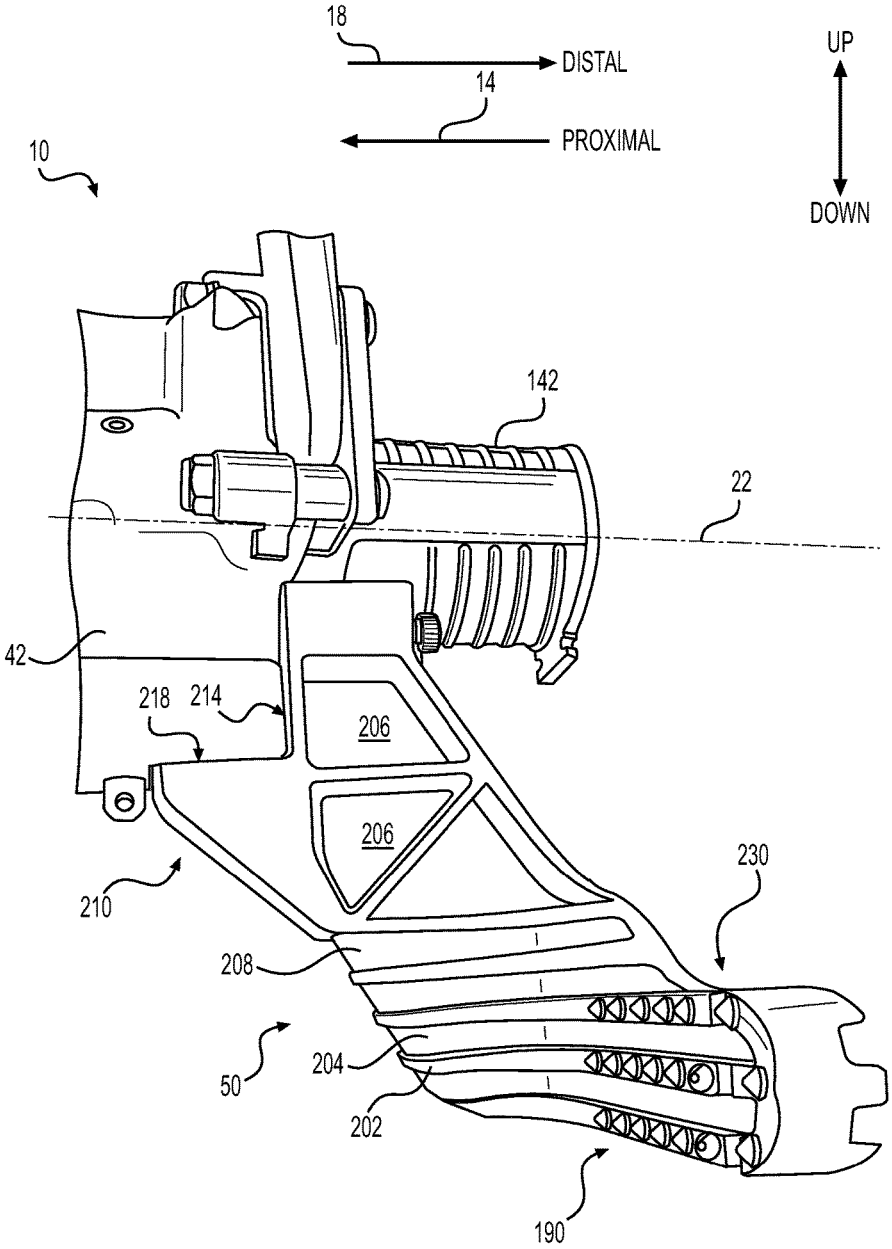
FIG. 46 is a right isometric view of a stirrup attached to a crossbow in accordance with an embodiment of the present invention.
Figure 47:
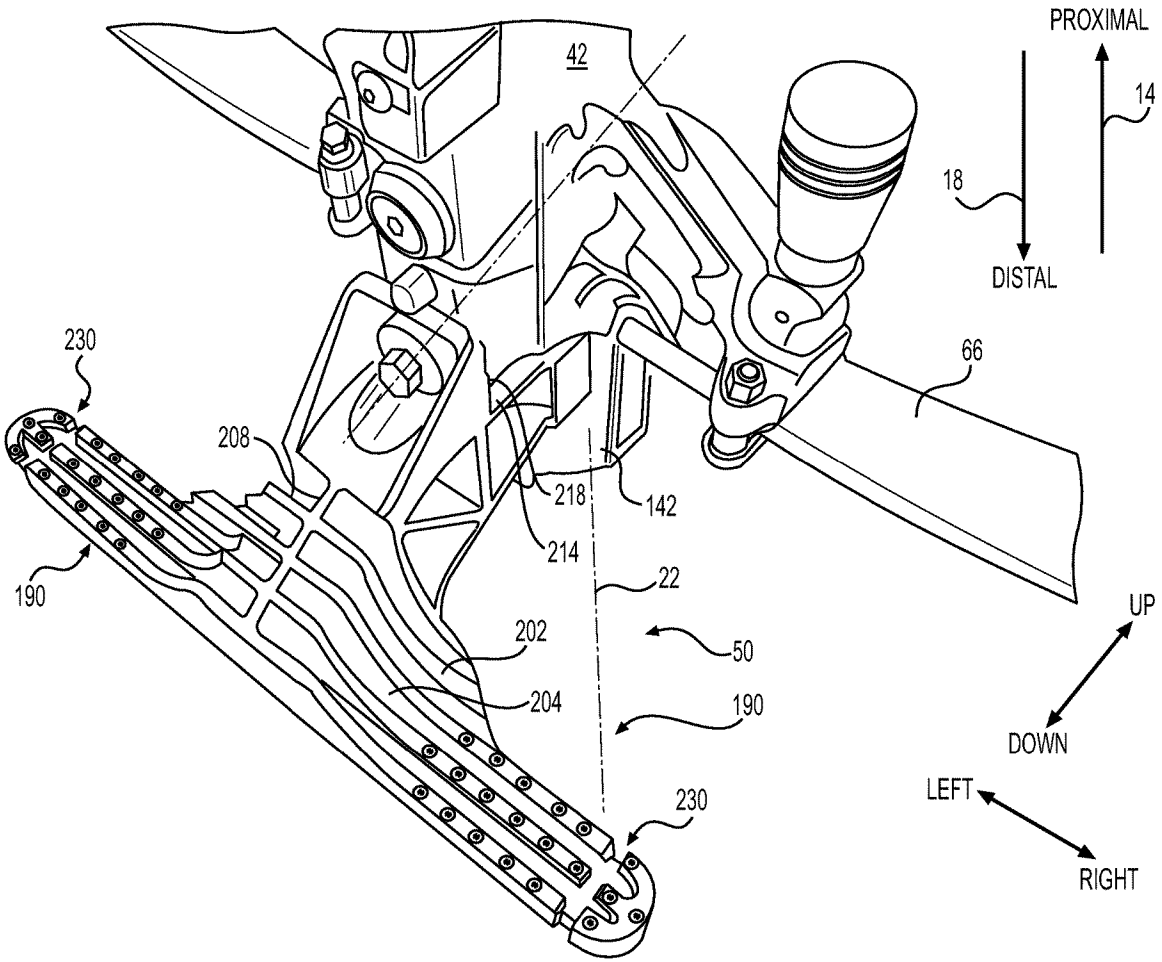
FIG. 47 is a top isometric view of an embodiment of the stirrup
Figure 48:
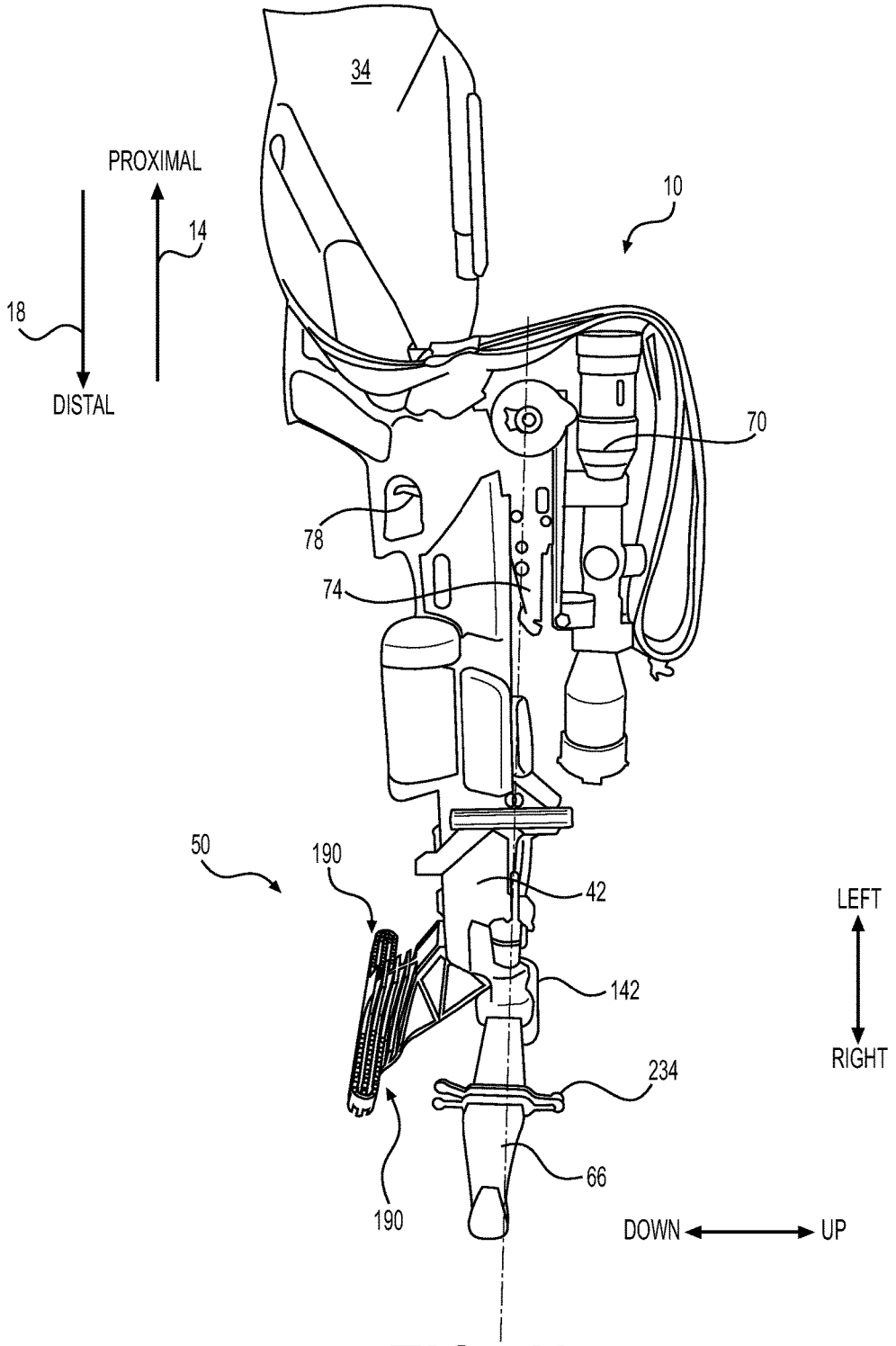
FIG. 48 is a right isometric view of an exemplary crossbow outfitted with an embodiment of the stirrup.
Figure 49:
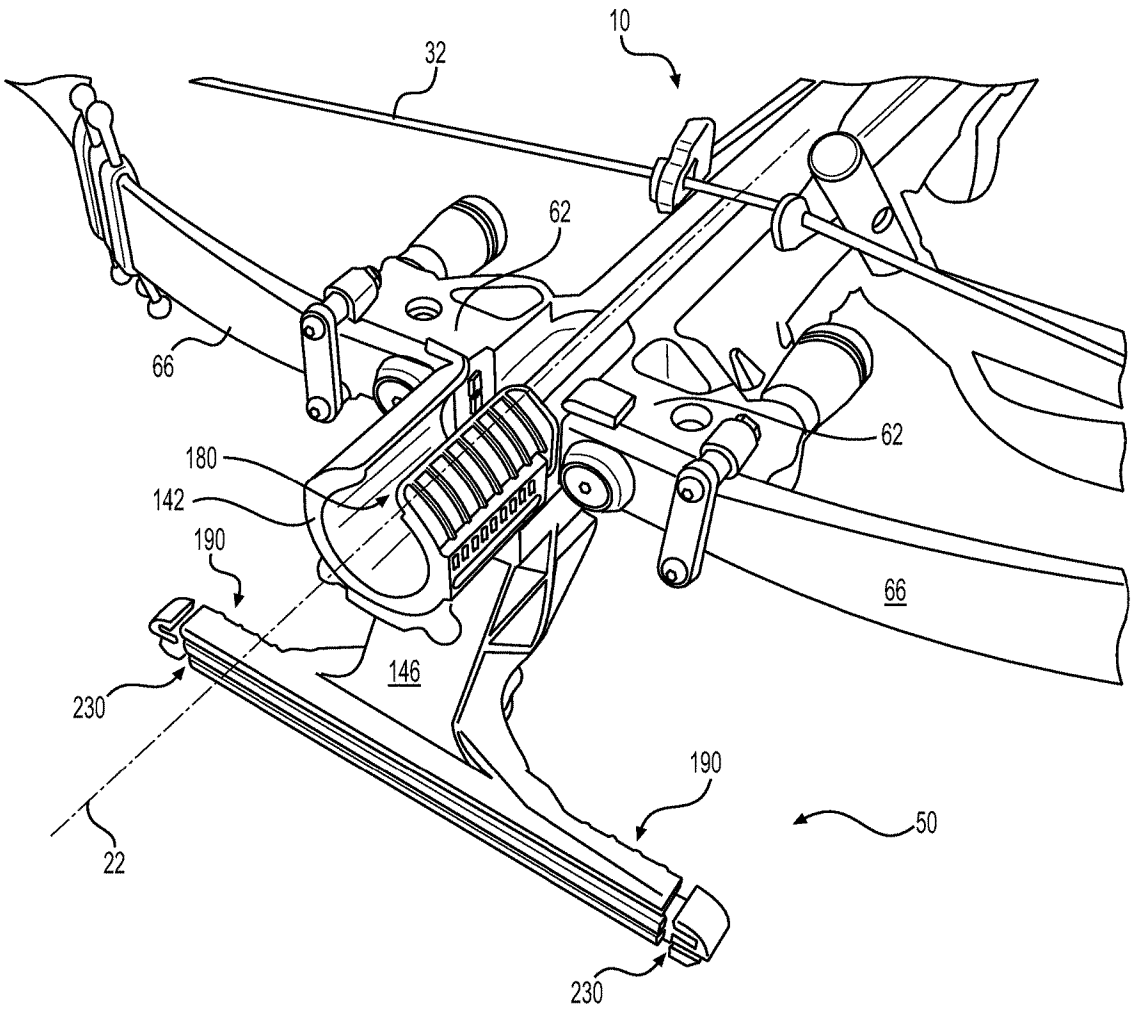
FIG. 49 is a bottom left isometric view of an embodiment of a stirrup attached to a crossbow in accordance with an embodiment of the present invention.
Figure 50:
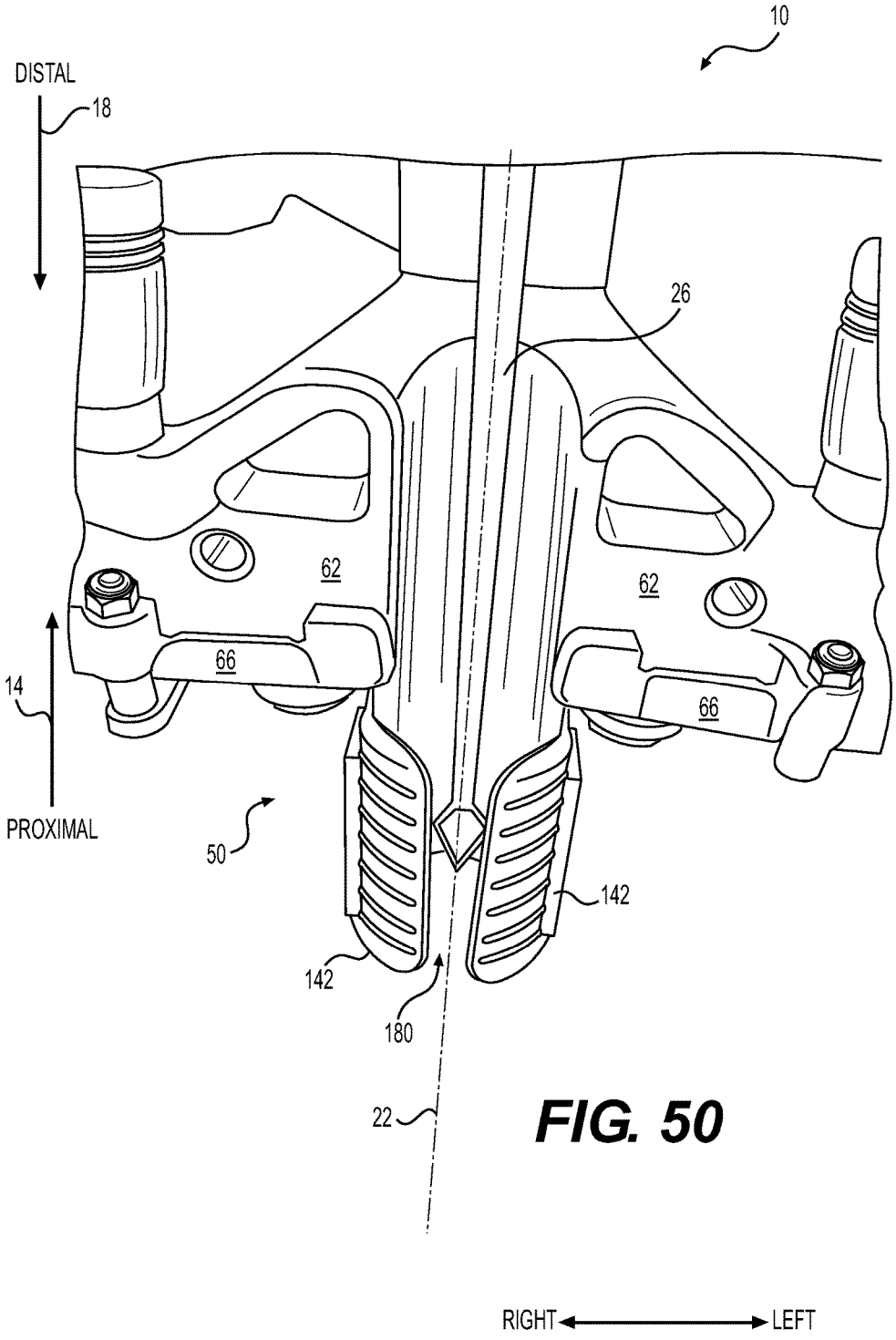
FIG. 50 is a top isometric view of an embodiment of a stirrup attached to a crossbow in accordance with an embodiment of the present invention.
Figure 51:
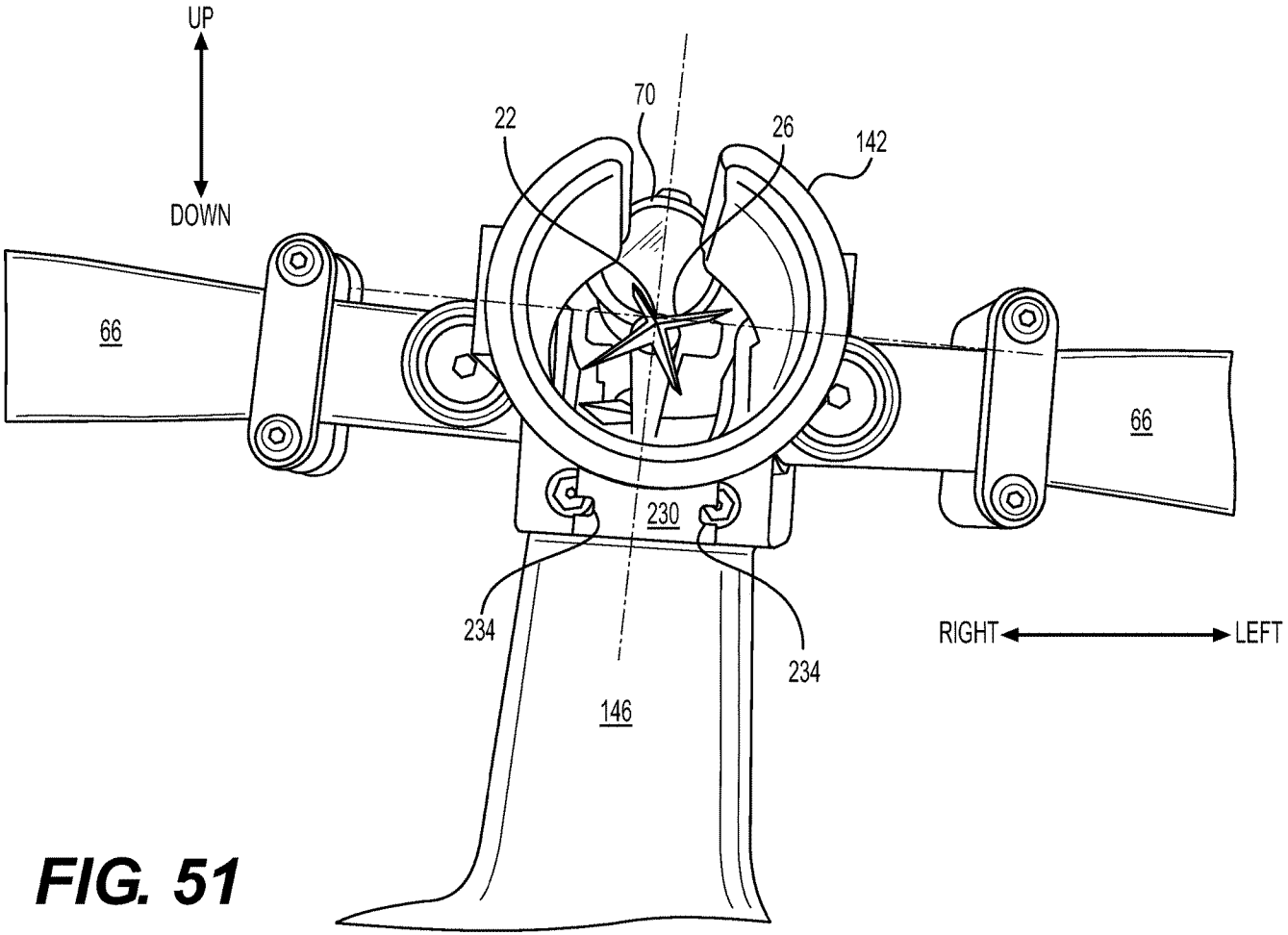
FIG. 51 is a bottom plan view of an embodiment of a stirrup attached to a crossbow in accordance with an embodiment of the present invention.

FIG. 44 throughout FIG. 51 are illustrating embodiments described above from various perspectives with additional details for the benefit of the reader. More precisely, FIG. 45 illustrates a multi-parts stirrup 50 including a foot-receiving portion 150 secured with a fastener 184 to the support 146. One can appreciate the stirrup 50 is not completely visible in FIG. 51 while the focus is put on the arrow protector 142.

The description and the drawings that are presented above are meant to be illustrative of the present invention. They are not meant to be limiting of the scope of the present invention.

Modifications to the embodiments described may be made without departing from the present invention, the scope of which is defined by the following claims:

1. A crossbow, comprising:

(a) a body including a longitudinal axis extending in a longitudinal direction;

(b) a pair of limbs affixed at a first location along the longitudinal axis, with a first limb of the pair extending on a first side of the body of the crossbow, and a second limb of the pair extending on a second side of the body of the crossbow opposite to the first side, the pair of limbs being adapted to transition between a distal configuration and a proximal configuration for accumulating energy, and return to the distal configuration for releasing energy;

(c) a string extending across the body and mounted on the pair of limbs, by which string an arrow is longitudinally propelled from a distal end of the body of the crossbow in the longitudinal direction when the pair of limbs returns to the distal configuration from the proximal configuration; and (d) an attachment having a one-piece configuration and connected by fasteners to the distal end of the crossbow, the attachment comprising, (i) a support portion extending from and beyond the distal end of the body of the crossbow at an angle to and below the longitudinal axis, and (ii) a protector portion only connected to the support portion at a proximal end of the support portion and including opposed walls extending upwardly and surrounding the longitudinal axis except for a longitudinally extending opening separating the opposed walls for passage of a shaft of an arrow during loading of the crossbow, the opposed walls defining a hollow portion for receiving therein and capable of protecting a broadhead of an arrow when installed on the crossbow in a position ready to be fired, with the hollow portion extending in the longitudinal direction beyond the distal end of the body of the crossbow and away from the first location at which the pair of limbs are affixed to the body of the crossbow, the attachment further comprising a pair of foot-receiving portions connected to the support portion, at a distal end thereof, with the entirety of each foot-receiving portion being offset from and located below the longitudinal axis of the body of the crossbow, the protector distally extending farther along the longitudinal axis from the pair of foot-receiving portions, a combined configuration of the pair of foot-receiving portions and the protector portion collectively providing a triangular ground-contacting support capable of maintaining the crossbow vertically on the ground, wherein the farther distally extending protector inclining the longitudinal axis from vertical toward the pair of foot-receiving portions when vertically maintained on the ground to transfer weight toward the pair of foot-receiving portions w hereby the weight transfer towards the ground within the triangular ground-contacting support to increase stability of the crossbow when vertically maintained on the ground.

2. The crossbow of claim 1, wherein the hollow portion is generally cylindrical.

3. The crossbow of claim 1, further comprising a pair of foot-receiving portions connected to the support portion at a distal end of the support portion, with the entirety of each foot-receiving portion being offset from and located below the longitudinal axis of the body of the crossbow, wherein an entirety of each foot-receiving portion is located in the longitudinal direction between the pair of limbs and a distalmost portion of the protector portion.

4. The crossbow of claim 1, wherein a first fastener extends through the attachment into an underside of the distal end of the body of the crossbow for fastening the attachment directly to the underside of the body of the crossbow, and wherein a second fastener extends through the attachment into a front of the distal end of the body of the crossbow for fastening the attachment directly to the front of the body of the crossbow, the first and second fasteners extending along orthogonal axes.

5. The crossbow of claim 1, further comprising a pair of foot-receiving portions connected to the support portion at a distal end of the support portion, with the entirety of each foot-receiving portion being offset from and located below the longitudinal axis of the body of the crossbow, wherein each foot-receiving portion is fixedly connected in cantilever to the support portion.

6. The crossbow of claim 1, further comprising a pair of foot-receiving portions connected to the support portion at a distal end of the support portion, with the entirety of each foot-receiving portion being offset from and located below the longitudinal axis of the body of the crossbow, wherein the support portion and foot-receiving portions together define a "T" shaped configuration, each foot-receiving portion comprising a terminal end of the "T" shaped configuration.

7. The crossbow of claim 1, further comprising a pair of foot-receiving portions connected to the support portion at a distal end of the support portion, with the entirety of each foot-receiving portion being offset from and located below the longitudinal axis of the body of the crossbow, wherein the first foot-receiving portion comprises a first array of spikes for engaging a foot, and the second foot-receiving portion comprises a second array of spikes for engaging a foot, the first array being separate and distinct from the second array with the first array being located on the first side of the body of the crossbow and the second array being located on the second side of the body of the crossbow.

8. The crossbow of claim 1, wherein the attachment is defined by a single piece of molded material.

9. The crossbow of claim 8, wherein the molded material comprises a polymer with reinforcing fibers.

10. The crossbow of claim 1, wherein the distal end of the crossbow body is located along the longitudinal axis between the pair of limbs and the protector portion of the stirrup.

11. An attachment for attaching to a distal end of a crossbow body, the attachment comprising a single piece of molded material defining:

a support portion having a mounting portion adapted to be attached to a distal end of a body of a crossbow, the support portion extending distally from the mounting portion at an angle to and below a longitudinal axis;

a pair of foot-receiving portions integrally formed to a distal end of the support portion, with a first foot-receiving portion of the pair extending from the distal end of the support portion to a distal end thereof on a first side of the support portion, and with a second foot-receiving portion of the pair extending from the distal end of the support portion to a distal end thereof on a second side of the support; and a protector portion integrally formed to a proximal end of the support portion and including opposed walls extending upwardly and surrounding the longitudinal axis on opposite sides thereof except for a longitudinally extending opening defined between the opposed walls for passage of a shaft of an arrow, the upwardly extending opposed walls defining a hollow portion for receiving therein and protecting a broadhead of an arrow, the pair of foot-receiving portions being offset from and located below the longitudinal axis of the body of the crossbow, the protector farther distally extending along the longitudinal axis from the par of foot-receiving portions, a combined configuration of the pair of foot-receiving portions and the protector portion collectively providing a triangular ground-contacting support capable of maintaining the crossbow vertically on the around, wherein the farther distally extending protector inclines the longitudinal axis from a vertical toward the pair of foot-receiving portions when the crossbow is vertically maintained on the ground to transfer weight toward the pair of foot-receiving portions whereby the weight transfer toward the ground within the triangular ground-contacting support to increase stability of the crossbow when vertically maintained on the ground.

12. The attachment of claim 11, further comprising fasteners for connecting the attachment to a distal end of a body of a crossbow.

13. The attachment of claim 11, further comprising a first fastener opening extending through the mounting portion for fastening directly to an underside of a distal end of a body of a crossbow, and further comprising a second fastener opening extending through the mounting portion for fastening directly to a front of a distal end of a body of a crossbow, wherein the first and second fastener openings extend along orthogonal axes.

14. The attachment of claim 11, wherein each foot-receiving portion is fixedly connected in cantilever to the support portion.

15. The attachment of claim 11, wherein the support portion and foot-receiving portions together define a "T" shaped configuration, each foot-receiving portion comprising a terminal end of the "T" shaped configuration.

16. A crossbow, comprising:

(a) a crossbow body with a longitudinal axis along which an arrow is propelled in a longitudinal direction;

(b) a pair of limbs affixed to the crossbow body at a first location along the longitudinal axis, the pair of limbs being adapted to move between a distal configuration and a proximal configuration for accumulating energy;

(c) a string mounted on the pair of limbs, by which string an arrow is longitudinally propelled from a distal end of the crossbow body in the longitudinal direction when the pair of limbs returns to the distal configuration from the proximal configuration; and (d) a stirrup having a one-piece configuration and fastened to the distal end of the crossbow body, the stirrup comprising (i) a support portion, (ii) a protector portion only connected to a proximal end of the support portion and located at and extending from the distal end of the crossbow body in a direction away from the first location at which the pair of limbs are affixed to the crossbow body, the protector portion including opposed walls extending upwardly and surrounding the longitudinal axis on opposite sides except for a longitudinally extending opening defined between the opposed walls that is sized to allow for passage of a shaft of an arrow, the upwardly extending walls defining a hollow portion for receiving and protecting a broadhead of an arrow when installed on the crossbow in a position ready to be fired, and (iii) a pair of cantilevered foot-receiving portions connected to a distal end of the support portion;

(e) wherein the stirrup is fastened to the distal end of the crossbow body by a first fastener extending therethrough into an underside of the distal end of the crossbow body so as to fasten the stirrup to the underside of the crossbow body, and by a second fastener extending therethrough into a front of the distal end of the crossbow body so as to fasten the stirrup to the front of the crossbow body, the pair of foot-receiving portions being offset from and located below the longitudinal axis of the body of the crossbow, the protector distally extending along the longitudinal axis from the pair of foot-receiving portions, a combined configuration of the pair of foot-receiving portions and the protector portion collectively providing a triangular ground-contacting support capable of maintaining the crossbow vertically on the ground, wherein the further distally extending protector inclines the longitudinal axis toward the pair of foot-receiving portions when the crossbow is vertically maintained on the ground to transfer weight toward the pair of foot-receiving portions whereby the weight transfer toward the ground within the triangular ground-contacting support to increase stability of the crossbow when vertically maintained on the ground.

17. The crossbow of claim 16, wherein the protector portion and the foot-receiving portions are fastened to the crossbow body only by the fastening of the stirrup to the underside and front of the crossbow body.

* * * * *